US012116845B2

(12) United States Patent
Trunk et al.

(10) Patent No.: US 12,116,845 B2
(45) Date of Patent: Oct. 15, 2024

(54) DEVICES, SYSTEMS, AND METHODS FOR EXPANDABLE BLOCK SETS

(71) Applicant: Schlumberger Technology Corporation, Sugar Land, TX (US)

(72) Inventors: Philip Trunk, Houston, TX (US); Juraj Irsa, Spring, TX (US); Craig Raisanen, Sugar Land, TX (US); Julia Creamer, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/259,650

(22) PCT Filed: Dec. 28, 2021

(86) PCT No.: PCT/US2021/073131
§ 371 (c)(1),
(2) Date: Jun. 28, 2023

(87) PCT Pub. No.: WO2022/147434
PCT Pub. Date: Jul. 7, 2022

(65) Prior Publication Data

US 2024/0068300 A1 Feb. 29, 2024

Related U.S. Application Data

(60) Provisional application No. 63/131,022, filed on Dec. 28, 2020.

(51) Int. Cl.

| | |
|---|---|
| ***E21B 10/32*** | (2006.01) |
| ***E21B 7/28*** | (2006.01) |
| ***E21B 10/627*** | (2006.01) |
| *E21B 17/10* | (2006.01) |
| *E21B 29/00* | (2006.01) |

(52) U.S. Cl.
CPC ..... *E21B 10/32* (2013.01); *E21B 7/28* (2013.01); *E21B 10/627* (2013.01); *E21B 17/1014* (2013.01); *E21B 29/005* (2013.01)

(58) Field of Classification Search
CPC ..... E21B 10/32; E21B 10/627
See application file for complete search history.

(56) References Cited

U.S. PATENT DOCUMENTS

| | | | | |
|---|---|---|---|---|
| 2,719,699 A * | 10/1955 | Baker | E21B 10/322 175/267 |
| 7,493,971 B2 * | 2/2009 | Nevlud | E21B 10/322 175/286 |
| 2013/0306380 A1 * | 11/2013 | Oesterberg | E21B 10/26 175/263 |
| 2021/0198951 A1 * | 7/2021 | Irsa | E21B 10/43 |

* cited by examiner

*Primary Examiner* — Catherine Loikith
(74) *Attorney, Agent, or Firm* — Jeffrey D. Frantz

(57) ABSTRACT

An expandable tool includes an expandable block set having a plurality of segments longitudinally arranged. Each segment of the plurality of segments has a segment configuration. The segment configurations of the expandable block are customized for a particular application, based on the anticipated formation type. During operation, the downhole segment wears or breaks away, exposing the uphole segment, which takes over as the primary segment.

20 Claims, 15 Drawing Sheets

DEVICES, SYSTEMS, AND METHODS FOR EXPANDABLE BLOCK SETS

CROSS-REFERENCE TO RELATED APPLICATIONS

This application is a national stage entry of International Application No. PCT/US2021/073131, filed Dec. 28, 2021, which claims the benefit of, and priority to, U.S. Patent Application No. 63/131,022 filed on Dec. 28, 2020, which is incorporated herein by this reference in its entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled. In some situations, an expandable downhole tool may expand the diameter of the wellbore, cut a portion of the casing, or perform any other cutting activity. Some downhole tools may include cutter blocks that may be selectively expanded.

SUMMARY

In some embodiments, an expandable tool includes an expandable block set. The expandable block set includes a plurality of segments arranged longitudinally. A first segment includes a first segment configuration and a second segment includes a second segment configuration. The first segment is configured to break away to expose the second segment. In some embodiments, the segments are separated by a slot. In some embodiments, the segments are integrally formed with a single base.

In some embodiments, a method for operating an expandable tool includes expanding an expandable block set including a first segment arranged longitudinally downhole from a second segment. The first segment extends radially from a housing at least as far as the second segment and engages the formation. The first segment wears such that at least a portion of the first segment breaks free and the second segment extends further from the housing than the first segment. After the portion of the first segment breaks free from the expandable block set, the formation is engaged with the second segment more than the first segment.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 through FIG. 2-3 are representations of an expandable downhole tool in the retracted and expanded configuration, according to at least one embodiment of the present disclosure;

FIG. 3-1 through FIG. 3-4 are representations of segments of an expandable tool set having different segment configurations, according to at least one embodiment of the present disclosure;

FIG. 4 is a representation of another expandable downhole tool in a retracted configuration, according to at least one embodiment of the present disclosure;

FIG. 6-1 through FIG. 6-3 are representations of an expandable block set in various stages of wear, according to at least one embodiment of the present disclosure;

DETAILED DESCRIPTION

This disclosure generally relates to devices, systems, and methods for expandable downhole tools. The expandable tool may include an expandable block set. The expandable block set may include two or more segments. In some embodiments, the segments may be longitudinally arranged and immediately adjacent each other. The expandable block set may be longitudinally movable, and the longitudinal movement may cause the expandable block set to extend radially. The segments may each include a segment configuration. During operation, the lower segment may wear, exposing the upper segment to the formation. In this manner, the expandable block set may include backup segments that take over engaging with (e.g., degrading, reaming) the formation when a lower segments wear away. Furthermore, the expandable block set may include different segments configured for use in different formation types. Additionally, the expandable block set may include different segments configured for use with downhole tools of varying costs.

Figure 1:
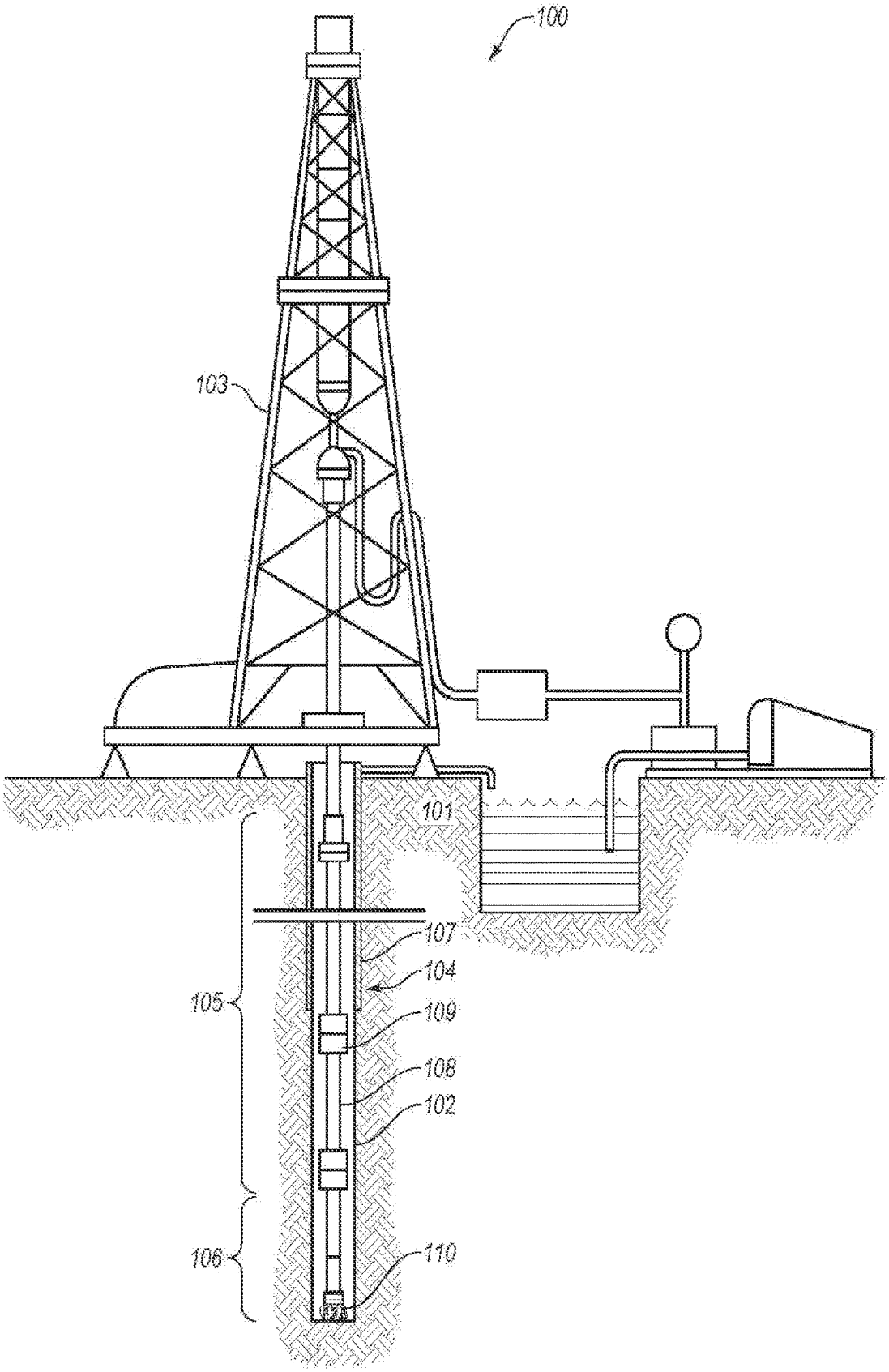
FIG. 1 is a representation of a downhole drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. In at least one embodiment, the BHA 106 may include an expandable tool, such as an expandable reamer, an expandable stabilizer, an expandable casing cutter, or any other expandable tool. The expandable tool may include an expandable block set, as discussed herein. As the expandable tool engages the formation 101, one or more segments of the expandable block set may wear or break away from the expandable block set, exposing a longitudinally adjacent uphole segment. Thus, an expandable tool may have backup segments, thereby extending the life of the expandable tool.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
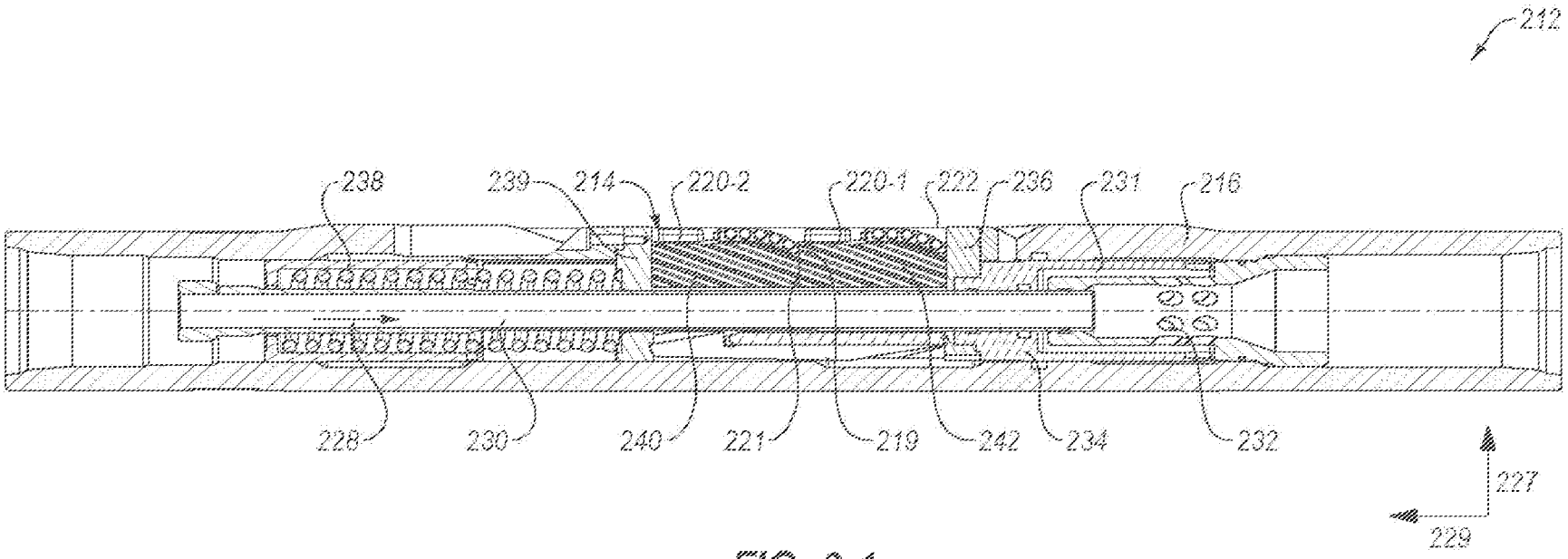
Figure 2:
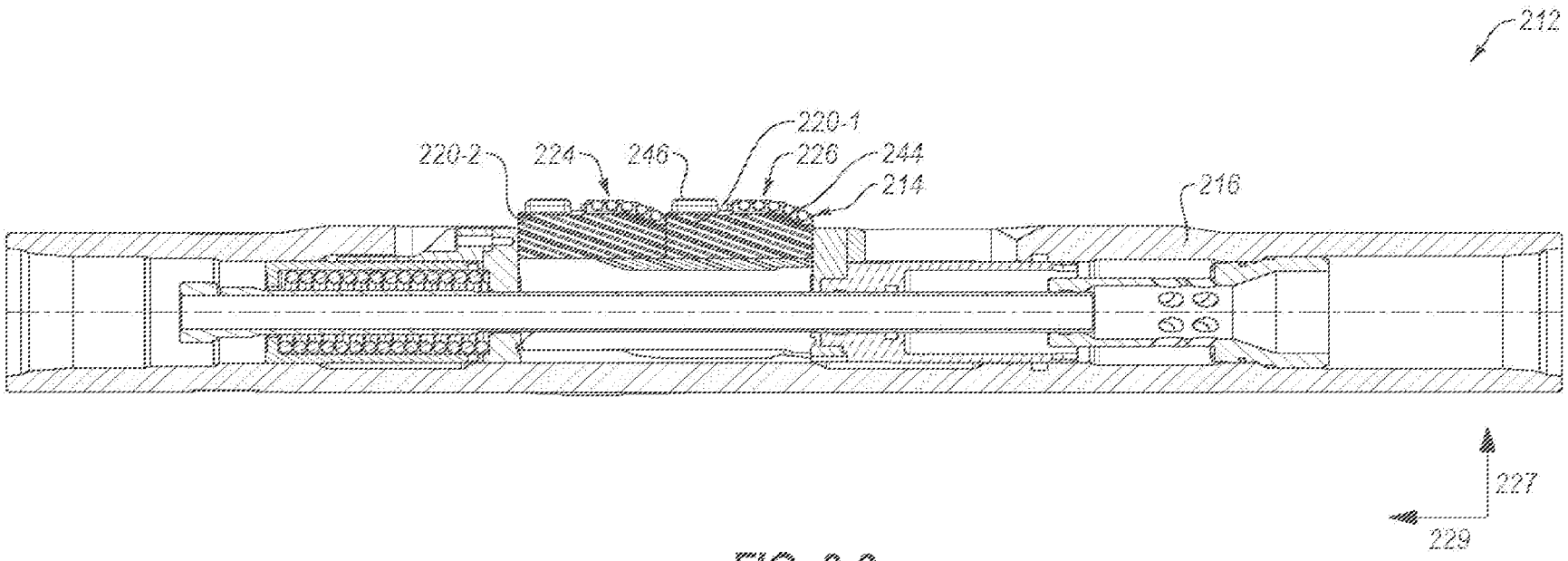

FIG. 2-1 is a representation of a cut-away view of an expandable downhole tool 212 in a retracted position, according to at least one embodiment of the present disclosure. The expandable downhole tool 212 shown is an expandable reamer. Further examples of expandable reamers may be found in U.S. Patent Application Publication No. 2021/0198952, filed Dec. 28, 2020, the disclosure of which is incorporated herein by reference in its entirety. In some embodiments, the expandable downhole tool 212 may be any expandable downhole tool. For example, the expandable downhole tool 212 may be an expandable cutting tool, such as a reamer, a casing cutter, a section mill, or any other expandable cutting tool. In some embodiments, the expandable downhole tool 212 may be any other expandable tool, such as an expandable stabilizer. In some embodiments, the expandable downhole tool 212 may be used while drilling. For example, an expandable reamer may be used while simultaneously drilling a pilot hole. In some embodiments, the expandable downhole tool 212 may be tripped downhole to cut material after a hole has been drilled. For example, the expandable downhole tool 212 may cut a section of a casing, may drill through a packer or a plug, or may ream a wider section of the wellbore.

Upon actuation, an expandable block set 214 may extend through an interior and past an exterior of a housing 216. The expandable block set 214 includes a plurality of segments. For example, the expandable block set 214 shown includes an upper segment 220-2 and a lower segment 220-1. The upper segment 220-2 and the lower segment 220-1 are arranged longitudinally. In other words, the upper segment 220-2 is immediately longitudinally adjacent to the lower segment 220-1. For example, a lower face of the upper segment 220-2 may abut against an upper face of the lower segment 220-1. In some embodiments, an entirety of the upper segment 220-2 may be located uphole of the lower segment 220-1.

It should be understood that the terms such as "upper" and "lower" may be used to show the relative location of the cutting blocks. However, the terms upper and lower may describe the relative location of the cutting blocks not only with respect to a force of gravity, but with respect to the direction of the hole. Thus, when drilling a horizontal or other non-vertical borehole, the term upper may indicate an uphole direction, or closer to the borehole collar. Similarly, the term lower may indicate a downhole direction, or closer to the bit. Thus, the upper segment 220-2 may be located above, with respect to the force of gravity, the lower segment 220-1, and/or the upper segment 220-2 may be located uphole of the lower segment 220-1.

In the embodiment shown, housing 216 includes an opening 222 therein. An expandable block set 214 is configured to be inserted through the opening 222. The upper segment 220-2 is arranged longitudinally with the lower segment 220-1 within the opening 222. In other words, the upper segment 220-2 may be located longitudinally adjacent the lower segment 220-1. For example, the upper segment 220-2 may be located uphole of the lower segment 220-1. A lower face 219 of the upper segment 220-2 may abut, or be immediately adjacent to, an upper face 221 of the lower segment 220-1.

Figures 2, 3:
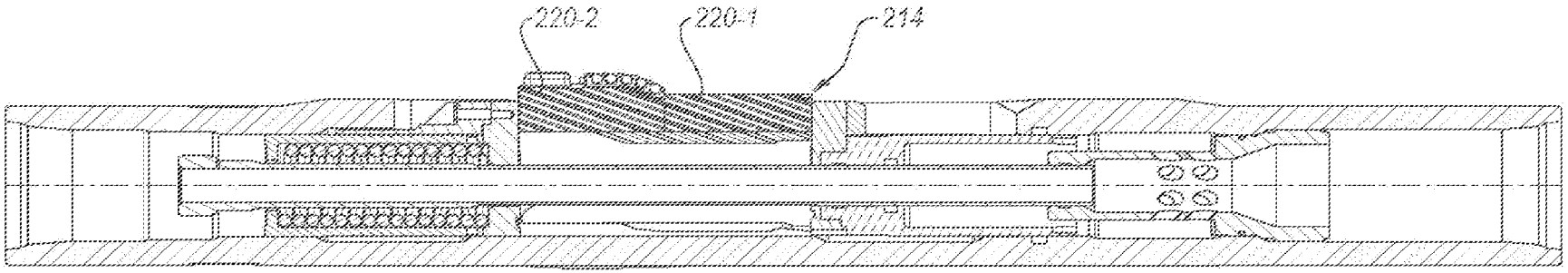

A fluid flow 228 may flow through a flow channel 230. The fluid flow 228 may enter a piston chamber 231 through ports 232 in the flow channel 230. Fluid pressure from the fluid flow 228 may push against an extension piston 234 (e.g., in the longitudinal direction 229), which may push on a lower push plate 236. A resilient member 238 (such as a spring) may push on an upper push plate 239 and provide a return force opposite the extension force from the fluid pressure (e.g., opposite the longitudinal direction 229). As the fluid pressure increases, the extension force increases. When the extension force exceeds the return force, the lower push plate 236 may push the expandable block set 214 uphole in the longitudinal direction 229. This may cause the expandable block set 214 to extend out of the opening 222 (e.g., in the radial direction 227) and away from the housing 216. While the cross-sections of the expandable downhole tool 212 shown in FIGS. 2-1 to 2-3 illustrate two segments 220 of the expandable block set 214, it is appreciated that the expandable downhole tool 212 may have multiple (e.g., 2, 3, 4, 5, or more) sets of segments 220. For example, the expandable block set 214 may have three sets of segments that are circumferentially spaced (e.g., approximately 120 degrees) apart from each other about the expandable downhole tool 212.

The upper segment 220-2 includes upper segment splines 240. The lower segment 220-1 includes lower segment splines 242. The upper segment splines 240 engage with housing splines to direct the upper segment 220-2 out of the housing. Similarly, the lower segment splines 242 engage with housing splines to direct the lower segment 220-1 out of the housing. The housing splines are located on a wall of the opening 222 of the housing 216. In some embodiments, the upper segment splines 240 may be protrusions or rails extending from the side surface of the upper segment 220-2. In some embodiments, the upper segment splines 240 may include grooves machined into the upper segment 220-2, with the upper segment splines 240 being the remaining material between adjacent grooves. In some embodiments, the upper segment splines 240 may be cast into the upper segment 220-2. In some embodiments, the upper segment splines 240 may be additively manufactured into the upper segment 220-2.

Similarly, in some embodiments, the lower segment splines 242 may be protrusions or rails extending from the side surface of the lower segment 220-1. In some embodiments, the lower segment splines 242 may include grooves machined into the lower segment 220-1, with the lower segment splines 242 being the remaining material between adjacent grooves. In some embodiments, the lower segment splines 242 may be cast into the lower segment 220-1. In some embodiments, the lower segment splines 242 may be additively manufactured into the lower segment 220-1.

As the fluid pressure increases, the lower push plate 236 may push the expandable block set 214 in the longitudinal direction 229. The engagement of the upper segment splines 240 and the lower segment splines 242 with housing splines on the housing may cause the expandable block set 214 to extend radially outward in the radial direction 227 to the expanded position shown in FIG. 2-2.

In the expanded position of FIG. 2-2, the expandable block set 214 may engage the formation (or other wellbore element, such as a casing, a packer, a plug, or any other wellbore element). The upper segment 220-2 includes an upper segment configuration 224 and the lower segment 220-1 includes a lower segment configuration 226. A segment configuration may include any elements of the segment 220. For example, the segment configuration may include the outer shape (i.e., outer profile) of the segment 220, the type of cutting elements on the segment, the number of cutting elements of the segment, the arrangement of cutting elements on the segment, the length of the segment, the extension of the segment past the housing 216, any other segment element, and combinations thereof. As will be discussed herein, the segment configurations of the upper segment 220-2 and the lower segment 220-1 may be optimized for different engagement mechanisms, such as abrasion, impact, stability, and so forth.

During downhole drilling operations, as the expandable block set 214 engages with the formation or wellbore element, the expandable block set 214 may experience wear and/or may chip, spall, or otherwise break. In some instances, the wear may cause one or more cutting elements 244 to fall off. This may reduce the effectiveness of the expandable downhole tool 212, resulting in delays to a downhole operation and increased maintenance costs. Furthermore, broken elements of the expandable block set 214 (e.g., elements that have fallen off of the expandable block set 214) may contact and/or damage other portions of a downhole drilling assembly. In some instances, damage to a conventional expandable block may be large enough to render the downhole tool ineffective, and a drilling operator may trip the downhole tool out of the hole before a drilling operation is completed, resulting in increased costs and operational delays.

In accordance with embodiments of the present disclosure, the expandable block set 214 may include multiple segments, such as the lower segment 220-1 and the upper segment 220-2 shown. During operation, the lower segment 220-1 may engage the formation or wellbore element. As may be seen in FIG. 2-2, the lower segment 220-1 may extend radially from the housing 216 at least as far as (e.g., the same amount or more than) the upper segment 220-2. Thus, during operation, the lower segment 220-1 may be the primary segment of the expandable block set 214. Put another way, the lower segment 220-1 may engage the formation or wellbore element more than the upper segment 220-2. For example, the lower segment 220-1 may receive more than 50%, more than 60%, more than 70%, more than 80%, more than 90%, more than 95%, 100%, or any value therebetween, of an engagement load caused by engagement of the expandable block set 214 with the formation or wellbore element. In some embodiments, the engagement load may be a longitudinal load (e.g., a load oriented in the longitudinal direction 229). In some embodiments, the engagement load may be a radial load (e.g., a load oriented in the radial direction 227). In some embodiments, the engagement load may be at least partially longitudinal and at least partially radial. In some embodiments, the lower segment 220-1 may protect the upper segment 220-2 from longitudinal loads.

In some embodiments, during operation, the upper segment 220-2 may extend at least as far as (e.g., the same amount or more than) the lower segment. Thus, during operation, the upper segment 220-2 may be the primary segment of the expandable block set 214. Put another way, the upper segment 220-2 may engage the formation or wellbore element more than the lower segment 220-1. For example, the upper segment 220-2 may receive more than 50%, more than 60%, more than 70%, more than 80%, more than 90%, more than 95%, 100%, or any value therebetween, of an engagement load caused by engagement of the expandable block set 214 with the formation or wellbore element.

As the lower segment 220-1 engages the formation or wellbore element, the lower segment 220-1 may experience wear. In some embodiments, wear on the lower segment 220-1 may reduce the exposure or extension of the lower segment 220-1 past the outer surface of the housing 216. In some embodiments, as may be seen in FIG. 2-3, an entirety of the lower segment 220-1 may be completely worn away (e.g., the cutting elements 244, gauge elements 246, and other features may break or wear away so that no portion of the lower segment 220-1 extends past the outer surface of the housing 216 in the extended position). In some embodiments, a portion of the lower segment 220-1 may be worn away so that a portion of the lower segment 220-1 extends past the outer surface of the housing 216 while the upper segment 220-2 extends past the worn-away lower segment 220-1. As discussed in detail below, breakaway features of one or more segments 220 may accelerate the wear of the respective segments 220 after a wear threshold has been achieved. That is, after a wear threshold has been met for the downhole segment 220, the breakaway features may increase the wear rate of the downhole segment 220, thereby providing a clear path for the next segment 220 to engage the formation or wellbore element more quickly than without the breakaway feature.

As the lower segment 220-1 wears or breaks away from the expandable block set 214, the upper segment 220-2 may extend past the housing further than the lower segment 220-1, and begin to take on more of the engagement load. In the embodiment shown in FIG. 2-3, the lower segment 220-1 has worn completely away, and the upper segment 220-2 will engage the formation or wellbore element. While FIG. 2-3 shows the exposed portion of the lower segment 220-1 as having worn completely away, it should be understood that wear of the lower segment 220-1 may be gradual or incremental, and that the upper segment 220-2 may begin engaging with the formation gradually, as the lower segment wears or breaks away.

By including multiple segments in the expandable block set 214, the operational life of the expandable block set may be increased. For example, the upper segment 220-2 and the lower segment 220-1 may have the same segment configuration (e.g., the upper segment configuration 224 and the lower segment configuration 226 may be the same). In this manner, the upper segment 220-2 may be a backup segment for the lower segment 220-1. This may increase the life of the expandable downhole tool 212, thereby reducing delays and decreasing operating costs.

In some embodiments, the upper segment 220-2 and the lower segment 220-1 may be separately formed. Put another way, the upper segment 220-2 and the lower segment 220-1 may be separate or independent elements, without a common base. When located inside the opening, lower face 219 (e.g., a lower end) of the upper segment 220-2 may be in contact with (e.g., touching, directly contacting, abutting, butted up against) the upper face 221 (e.g., the upper end) of the lower segment 220-1. In some embodiments, the lower face 219 and the upper face 221 may be flat. In some embodiments, pressure formed by compression between the lower push plate 236 and the upper push plate 239 may keep the upper segment 220-2 pressed against the lower segment 220-1. In some embodiments, the lower face 219 and the upper face 221 may include complementary interlocking elements, such as a dovetail connection.

In some embodiments, the upper segment 220-2 and the lower segment 220-1 may be interchangeable. Put another way, the upper segment 220-2 of FIG. 2-1 through FIG. 2-3 may be installed in the position of the lower segment 220-1, and the lower segment 220-1 may be installed in the position of the upper segment 220-2. In some embodiments, such as the embodiment shown in FIG. 2-1 through FIG. 2-3, the upper segment configuration 224 may be the same as the lower segment configuration 226. In some embodiments, the upper segment configuration 224 may be different than the lower segment configuration 226. Having different segment configurations 224, 226 may allow the operator to create an expandable block set 214 that is specific to a given use. For example, a segment configuration may be configured to engage with the formation or wellbore element with an abrasion mechanism, such as for medium-hardness formations. In some examples, a segment configuration may be configured to engage with the formation with an impact mechanism, such as for high-hardness formations. In some examples, a segment configuration may be arranged with planar cutting elements, and another segment configuration may be arranged with non-planar cutting elements (e.g., conical elements, ridge elements).

In some embodiments, based on survey data and/or offset data, an operator may determine that a segment configuration configured with an abrasion mechanism may be well suited for a first formation type or wellbore element type, and that a segment configuration configured with an impact mechanism may be well suited for a second formation type or wellbore element type. If the first formation type or wellbore element type is located uphole of the second formation type or wellbore element type, the operator may equip the lower segment 220-1 with the first segment configuration (configured with the abrasion-resistance mechanism) and the upper segment 220-2 with the second segment configuration (configured with the impact-resistance mechanism). When the expandable downhole tool 212 reaches the first formation type or wellbore element type, the lower segment 220-1 may engage the formation or wellbore element. When the expandable downhole tool 212 reaches the second formation type or wellbore element type, the lower segment 220-1 may wear away (e.g., because it is less-suited to the second formation or wellbore element type), and the upper segment 220-2 may engage the second formation type or wellbore element type. In this manner, an operator may customize the expandable downhole tool for a specific wellbore or wellbore plan. Including two different types of segment configurations may reduce the number of times the expandable downhole tool 212 needs to be tripped to the surface for maintenance because of cutting element or expandable tool profiles that are not well suited to engage with a given formation or wellbore element.

In some embodiments, the upper segment splines 240 may be circumferentially aligned with the lower segment splines 242. In this manner, the upper segment 220-2 and the lower segment 220-1 may engage with the same housing splines, and the upper segment 220-2 and the lower segment 220-1 may extend in the radial direction 227 at the same rate. In some embodiments, the upper segment splines 240 and the lower segment splines 242 may be circumferentially offset. This may help to account for spacing and/or other dimensional differences between the upper segment 220-2 and the lower segment 220-1.

Figures 2, 3:
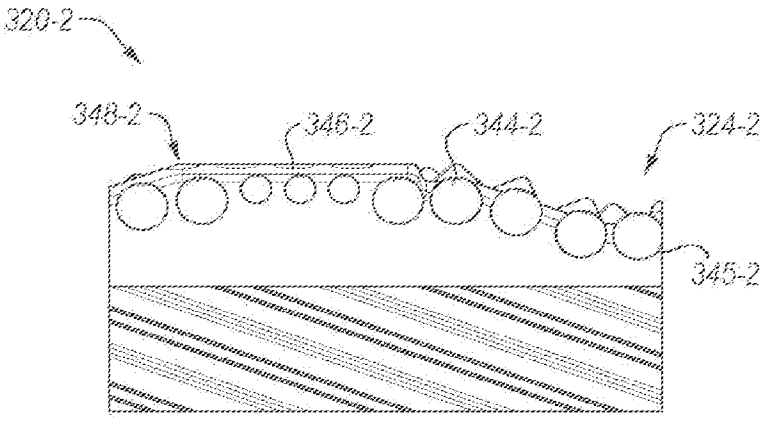
Figures 3, 4:
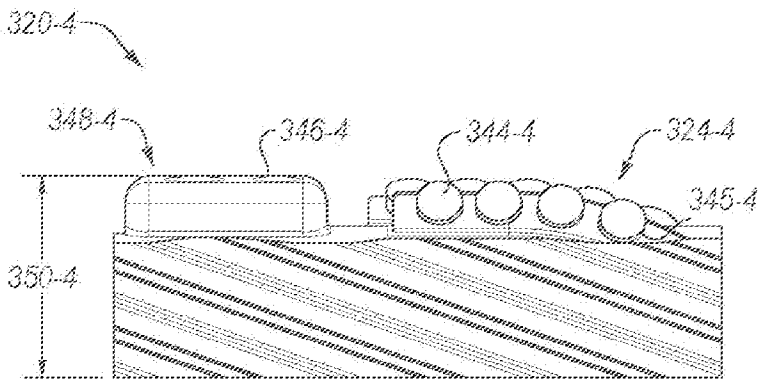
Figures 1, 3:
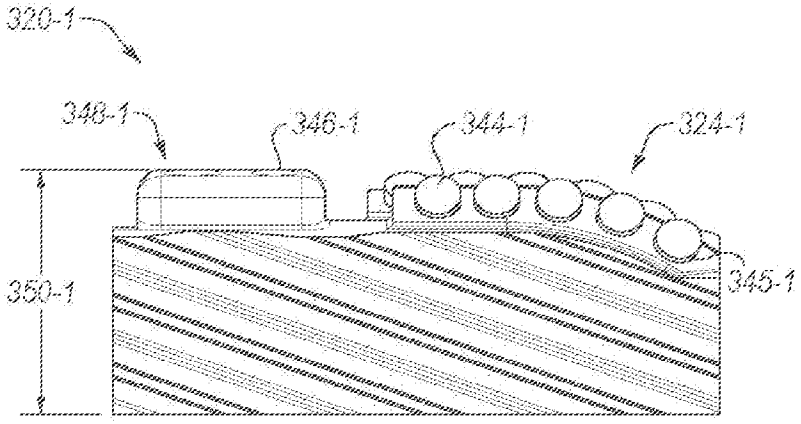
Figure 3:
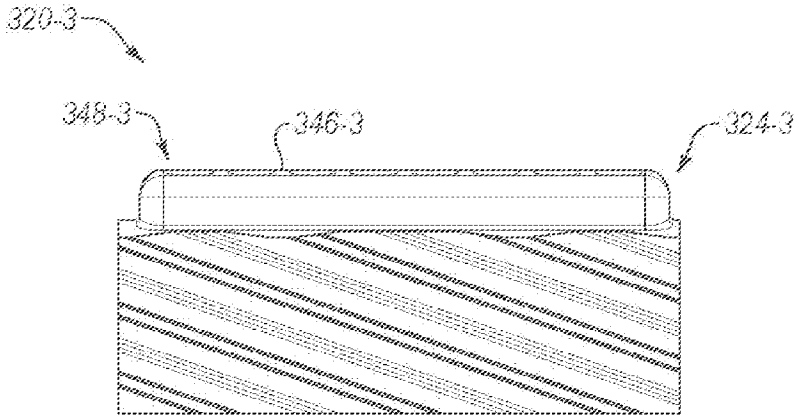
Figure 4:
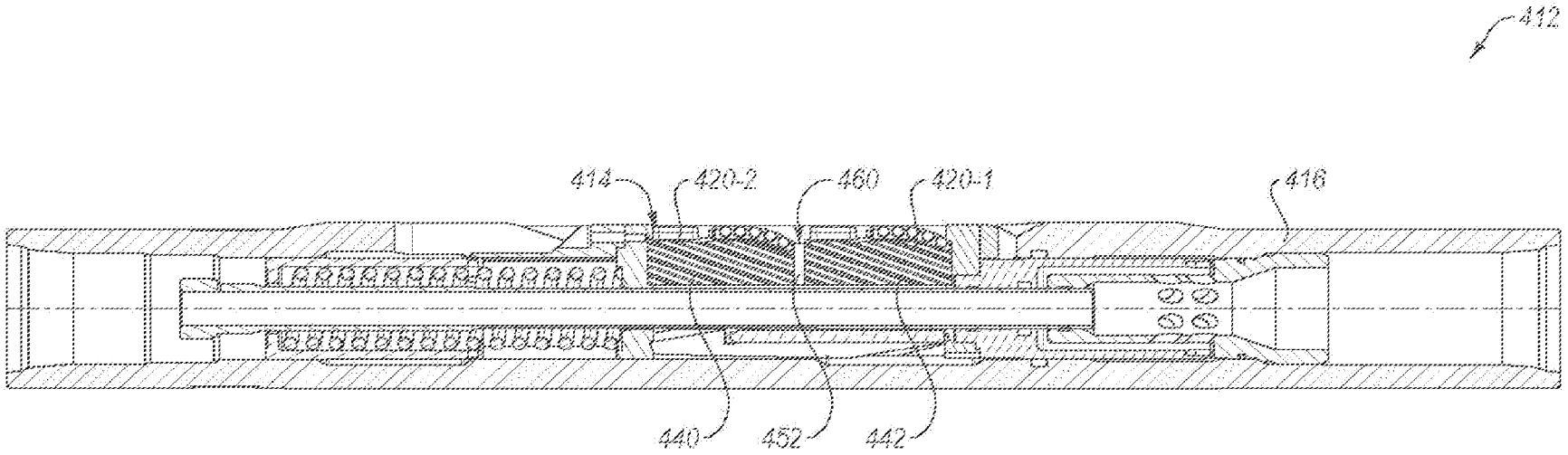

Segments of the expandable block set 214 may include any type of segment configuration. In accordance with embodiments of the present disclosure, FIG. 3-1 through FIG. 3-4 are representations of individual segments (collectively 320) of an expandable block set (e.g., expandable block set 214 of FIG. 2-1), each of which have a segment configuration (collectively 324). The segments 320 may be assembled in any order to create an expandable block set that is customized for a specific wellbore.

In the embodiment shown in FIG. 3-1, a first segment 320-1 has a first segment configuration 324-1. The first segment configuration 324-1 includes a plurality of first cutting elements 344-1 arranged in cutter pockets 345-1. The first cutting elements 344-1 may include planar cutting elements, which may be configured to remove formation or other wellbore elements in an abrasive environment. The first segment configuration 324-1 may further include a first gauge section 348-1 that includes one or more gauge cutting elements 346-1 (e.g., wear elements). The first gauge section 348-1 may extend the same or greater distance from the body of the first segment 320-1 than the first cutting elements 344-1.

In the embodiment shown in FIG. 3-2, a second segment 320-2 has a second segment configuration 324-2. The second segment configuration 324-2 may include one or more second cutting elements 344-2 arranged in cutter pockets 345-2. The second cutting elements 344-2 may be non-planar cutting elements, such as the conical cutting elements shown. In this manner, the second segment configuration 324-2 may be configured to remove formation or other wellbore elements in an impact environment. In some embodiments, the second cutting elements 344-2 may include multiple types of cutting elements, such as a mixture of planar and non-planar cutting elements. The second segment configuration 324-2 may further include a second gauge section 348-2 that includes one or more gauge cutting elements 346-2 (e.g., wear elements). The second gauge section 348-2 may extend the same or greater distance from the body of the second segment 320-2 than the second cutting elements 344-2.

In the embodiment shown in FIG. 3-3, a third segment 320-3 has a third segment configuration 324-3. The third segment configuration 324-3 may be formed entirely or almost entirely from a third gauge section 348-3 having one or more gauge inserts 346-3 (e.g., bearing or passive elements). In this manner, the third segment 320-3 may be configured to provide another segment 320 with stability during downhole drilling operations. In some embodiments, the third segment 320-3 may be manufactured entirely from a wear-resistant material, and the third segment 320-3 may not include any inserts 346-3, cutting elements, bearing elements, passive elements, or any other inserted element.

In the embodiment shown in FIG. 3-4, a fourth segment 320-4 has a fourth segment configuration 324-4. The fourth segment configuration 324-4 may be similar to the first segment configuration 324-1 of FIG. 3-1 or the second segment configuration 324-2 of FIG. 3-2 with a plurality of cutting elements 344-4 arranged in cutter pockets 345-4. In some embodiments, the fourth segment configuration 324-4 may have a fourth segment height 350-4 (e.g., a distance from a base of the fourth segment 320-4 to a fourth gauge cutting element 346-4 in a fourth gauge region 348-4) that is less than a first segment height 350-1. Because the fourth segment configuration 324-4 has a smaller fourth segment height 350-4, the fourth segment 320-4, in combination with another segment having a full segment height (e.g., the first segment 320-1 having a first segment height 350-1), the fourth segment 320-4 may extend the wellbore to a first diameter, and the other segment may extend the wellbore to a second, larger diameter. This may help to reduce the wear on both segments 320.

In some embodiments, segments 320 may be prepared with a segment configuration 324 having any gauge region 348, cutting element 344, first segment height 350-1, any other element, dimension, or factor of a segment, and combinations thereof, including experimental or test segment configurations 324. In some embodiments, segments 320 have multiple rows of cutting elements 344 and/or gauge regions 348. As discussed below with FIG. 5, a longitudinal channel may extend between rows of a segment 320. In some embodiments, an expandable block set may be assembled using any combination of segments 320. For example, the first segment 320-1 may be a lower segment (e.g., lower segment 220-1 of FIG. 2-1) and the second segment 320-2 may be an upper segment (e.g., upper segment 318 of FIG. 2-1). In some examples, the second segment 320-2 may be a lower segment and the first segment 320-1 may be an upper segment. In some embodiments, the third segment 320-3 may be an upper segment for any other lower segment. In some embodiments, the fourth segment 320-4 may be a lower segment for any other upper segment. In some embodiments, a test segment (e.g., a segment including an experimental or trial segment configuration 324) may be included with another, known segment to determine how the test segment operates in a given formation or wellbore element. While embodiments of the present disclosure have discussed and shown an expandable block set that includes two segments 320, it should be understood that an expandable block set may include any number of segments 320. Including different segments 320 in an expandable block set may allow an operator to customize an expandable block set for a variety of different conditions. This may increase the functional life of an expandable downhole tool, thereby decreasing downtime due to tripping the expandable downhole tool out of the borehole.

FIG. 4 is a representation of an expandable downhole tool 412 in a retracted configuration, according to at least one embodiment of the present disclosure. The expandable downhole tool 412 includes an expandable block set 414 with an upper segment 420-2 located longitudinally adjacent and uphole to a lower segment 420-1. In the embodiment shown, the upper segment 420-2 is separated from the lower segment 420-1. In some embodiments, the upper segment 420-2 may be separated from the lower segment 420-1 with a spacer 452. In some embodiments, the upper splines 440 and the lower splines may be misaligned (e.g., a single spline followed from the upper segment 420-2 to the lower segment 420-1 may not be continuous). In some embodiments, separating the upper segment 420-2 from the lower segment 420-1 with a spacer may help to align the upper splines 440 with the lower splines 442.

In some embodiments, separating the upper segment 420-2 from the lower segment 420-1 with a spacer 452 may create a slot 460 between the upper segment 420-2 and the lower segment 420-1. When the lower segment 420-1 wears or breaks away, the slot 460 between the upper segment 420-2 and the lower segment 420-1 may provide a space for the upper segment 420-2 to clearly engage the formation, with less obstruction by the lower segment. In some embodiments, the spacer 452 may be narrower than the blocks to prevent the spacer 452 from getting caught in the housing 416 of the expandable downhole tool 412 during expansion or contraction of the expandable block set 414.

Figure 5:
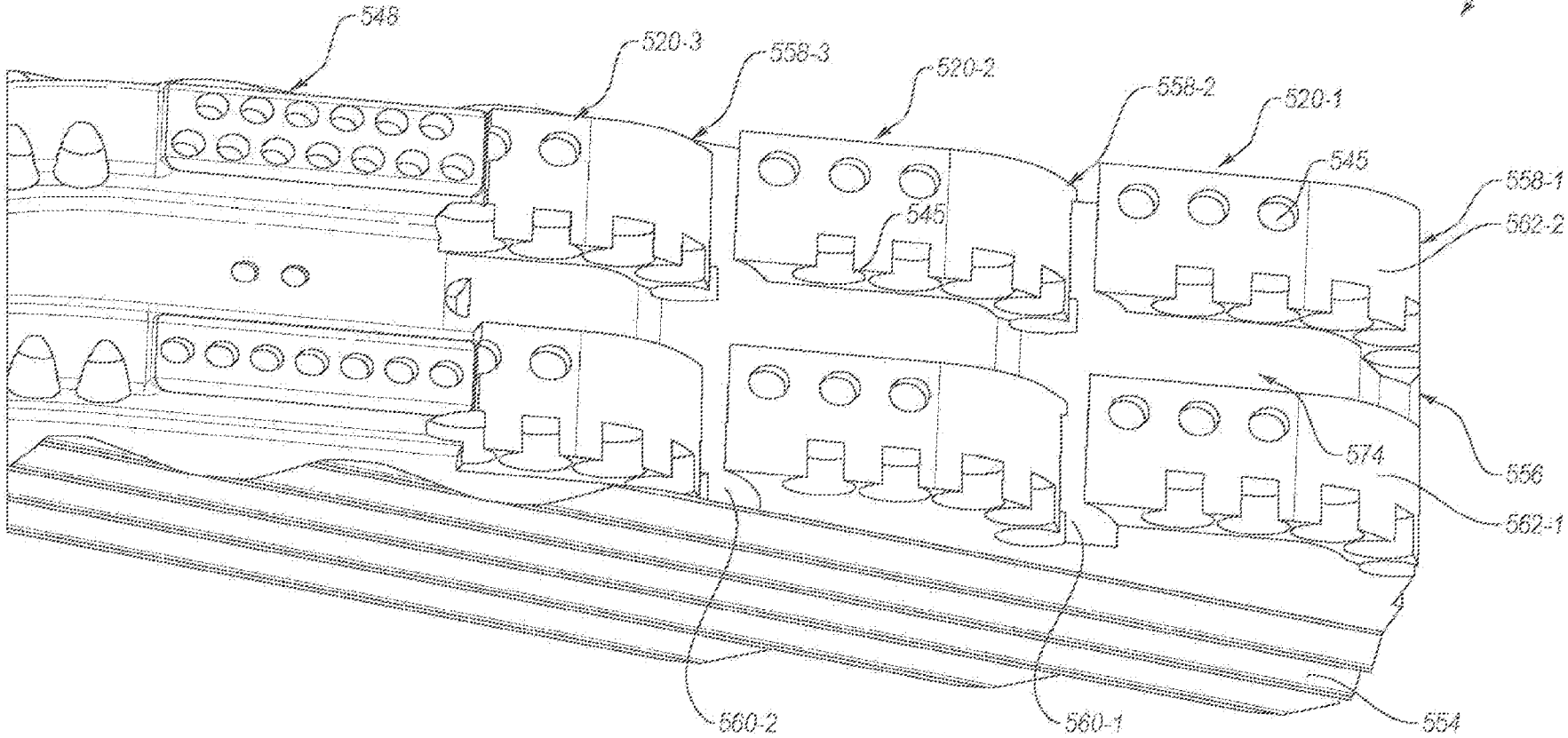
FIG. 5 is a representation of a perspective view of an expandable block set, according to at least one embodiment of the present disclosure.

FIG. 5 is a representation of an expandable block set 514 including a plurality of segments (collectively 520) connected to a single base 554, according to at least one embodiment of the present disclosure. The expandable block set 514 may be inserted into a housing (e.g., the housing 216 of FIG. 2-1) and be expanded and retracted based on a fluid pressure, as discussed herein. The segments 520 are connected to the base 554 such that when the base is extended out of the housing, the segments 520 are extended as well. Cutting elements may be coupled to and/or inserted into the cutter pockets 545 of the segments 520.

In some embodiments, multiple segments 520 are connected to or integrally formed with the base 554. For example, the embodiment shown in FIG. 5 shows three segments 520 connected or integrally formed with a single base 554. A first segment 520-1 may be located at a downhole end 556 of the expandable block set 514. A second segment 520-2 may be located uphole of the first segment 520-1, and a third segment 520-3 may be located uphole of the second segment 520-2 and the first segment 520-1. In some embodiments, a gauge section 548 may be located uphole of the third segment 520-3, the second segment 520-2, and the first segment 520-1.

During downhole drilling operations, the expandable block set 514 may be expanded to perform a function, such as to ream a borehole wall, cut a casing, cut a downhole plug, or perform any other function. The first segment 520-1 may be the downhole most segment 520. A first downhole edge 558-1 of the first segment 520-1 may be exposed to and engage the formation, borehole wall, or other wellbore element. As the first segment 520-1 engages the formation, the first segment 520-1 may experience wear. Wear on the first segment 520-1 may cause the first segment 520-1 to break away from the base 554. As discussed in detail below, breakaway features of one or more segments 520 may accelerate the wear of the respective segments 520 after a wear threshold has been achieved.

After the first segment 520-1 has broken away, the second segment 520-2 may be exposed. Put another way, after the first segment 520-1 has broken or worn away from the base 554, the second segment 520-2 may become the downhole-most segment 520, and a second downhole edge 558-2 of the second segment 520-2 may be exposed to and engage the formation, borehole wall, or other wellbore element. That is, the second segment 520-2 may then engage the formation or wellbore element more completely than before the first segment 520-1 degraded. This may cause the second segment 520-2 to experience wear, and the second segment 520-2 may eventually break away from the base 554. The breaking away of the second segment 520-2 may cause the third segment 520-3 to become the downhole-most segment 520, and a third downhole edge 558-3 may be exposed to and engage the formation, borehole wall, or other wellbore element more completely than before the second segment 520-2 was degraded. As discussed below, upper segments (e.g., third segment 520-3, second segment 520-1) may have protective materials, inserts, or elements to reduce exposure of cutting elements on the upper segments until the respective upper segment is the downhole-most segment 520. The multiple segments of the expandable block set, breakaway features, and segment protection features may be configured to preserve the integrity of uphole segments while downhole segments of the expandable block set remain effective, yet facilitate a rapid transition to the uphole segment after the downhole segment degrades and loses effectiveness.

By including multiple segments 520 on the same expandable block set 514, the expandable block set 514 may have an increased operational life. For instance, the second segment 520-2 may be a backup segment for the first segment 520-1, and the third segment 520-3 may be a backup segment for the second segment 520-2. Thus, the expandable block set 514 may have an increased operational life, thereby reducing maintenance and other operational costs corresponding to repairing or replacing an expandable block that only includes a single segment.

The segments 520 may be separated by a slot (collectively 560). For example, the first segment 520-1 and the second segment 520-2 may form a first slot 560-1 and the second segment 520-2 and the third segment 520-3 may form a second slot 560-2. In some embodiments, the slots 560 may provide a separation between the segments 520. Thus, when a segment 520 wears or breaks away, the next uphole segment 520 may have little or no interference from any remaining portion of the downhole segment 520. This may allow the uphole segment 520 to take over cutting or other drilling operations from the downhole segment with limited interference. As may be seen, the slots 560 may extend across an entire width of a segment 520. Put another way, a slot 560 may extend from a leading edge to a trailing edge of the segment 520. In some embodiments, a slot may extend across an entirety of a width of the expandable block set 514. In some embodiments, a slot may extend from a leading edge of the segment 520 to a channel between rows of segments 520, or to a trailing edge of the expandable block set 514.

In some embodiments, the slots 560 may further provide fluid pathways for drilling fluid. This may help to increase the cooling effect of the drilling fluid on the cutting elements of the segments 520. This may further help to wash away cuttings, swarf, or other downhole debris that may collect at or around the segments 520. Cooling and cleaning the area around the segments 520 may help to increase the operational life of the expandable block set 514.

In the embodiment shown, the segments 520 are separated circumferentially into a leading row 562-1 and a trailing row 562-2, with the leading row 562-1 being rotationally ahead of the trailing row 562-2 and separated by a longitudinal channel 574. In some embodiments, the segments 520 on the leading row 562-1 may wear evenly with the segments 520 on the trailing row 562-2. Thus, the downhole segments 520 on both the leading row 562-1 and the trailing row 562-2 may wear or break away from the base 554 at the same time, exposing the uphole downhole segments. In some embodiments, the segment 520 on the leading row 562-1 may wear faster than the segment 520 on the trailing row 562-2. This may cause the uphole segment 520 on the leading row 562-1 to be exposed before the uphole segment 520 on the trailing row 562-2. In this manner, the expandable block set 514 may be configured to maintain a fresh segment against formation, even if the downhole segment 520 wears or breaks away from the base 554.

Figures 1, 6:
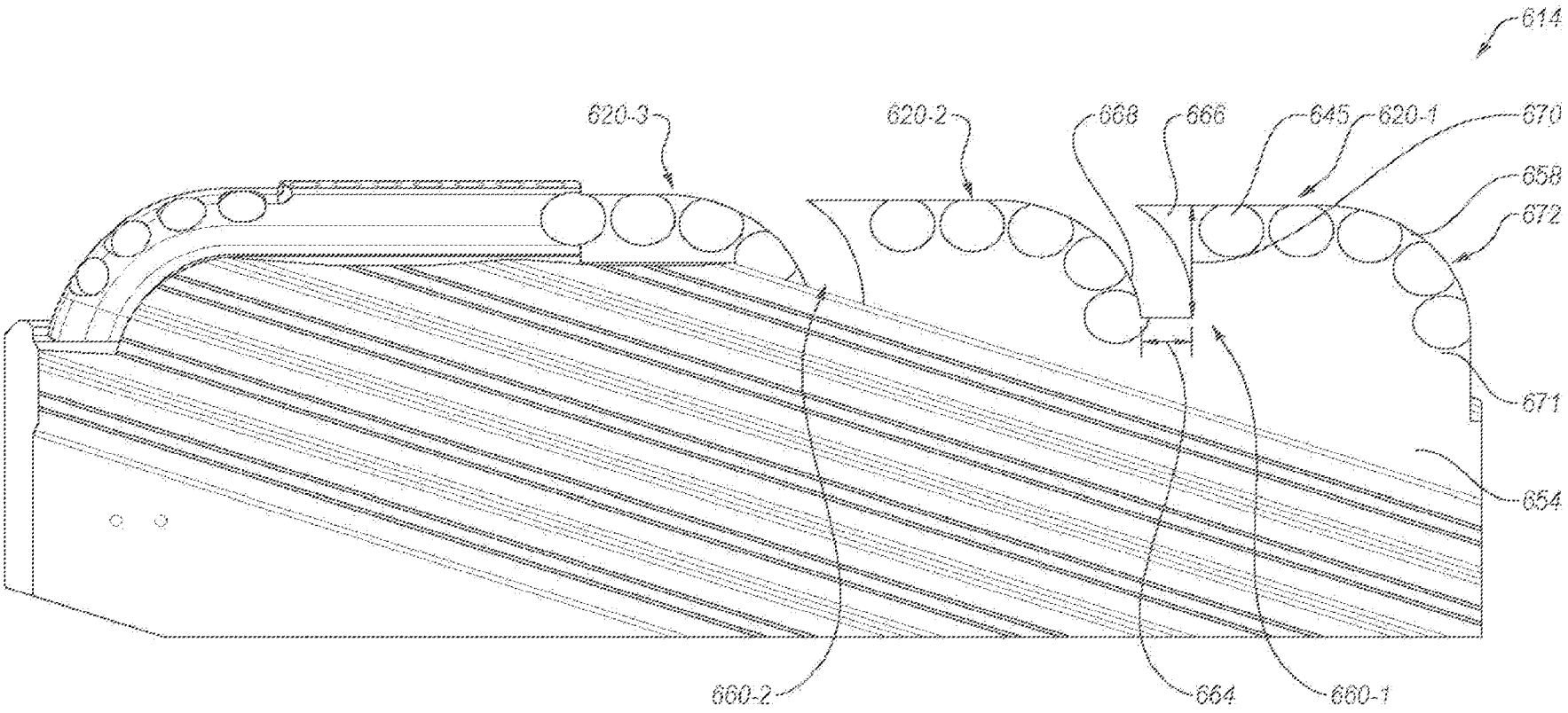
Figures 2, 6:
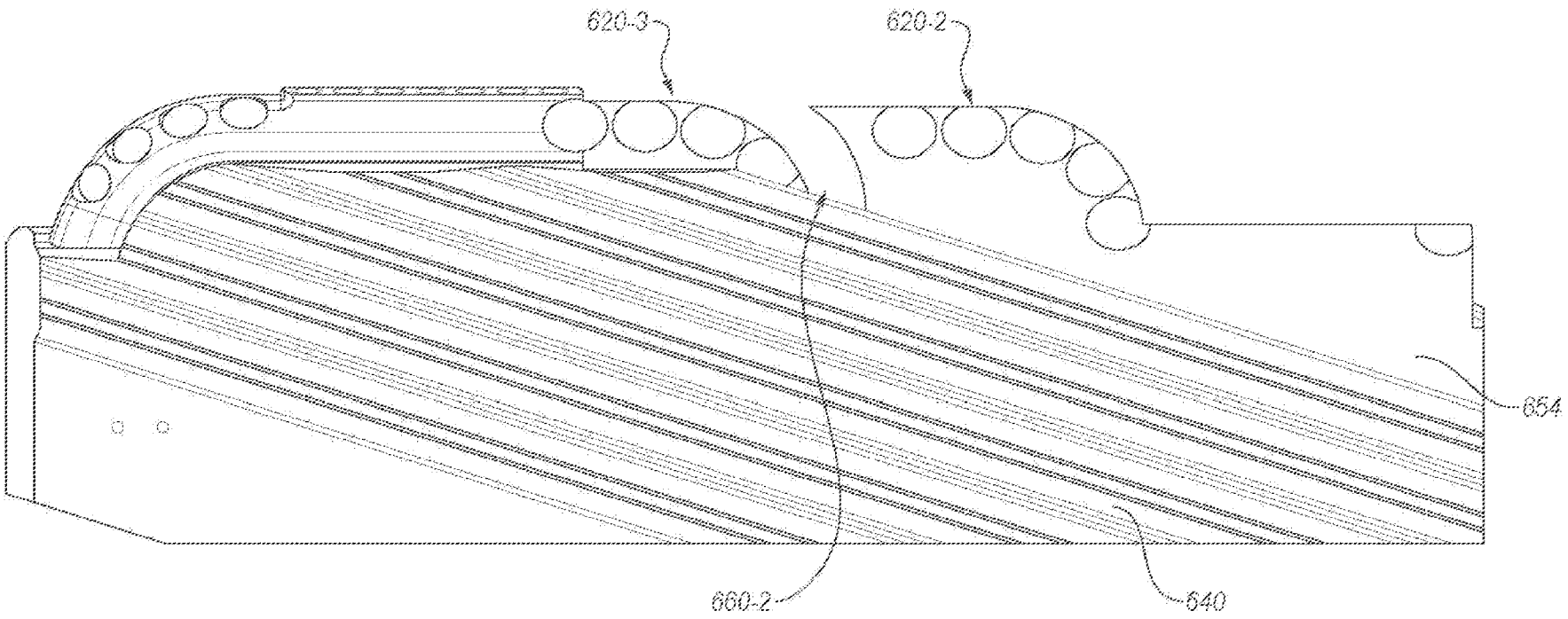
Figures 3, 6:
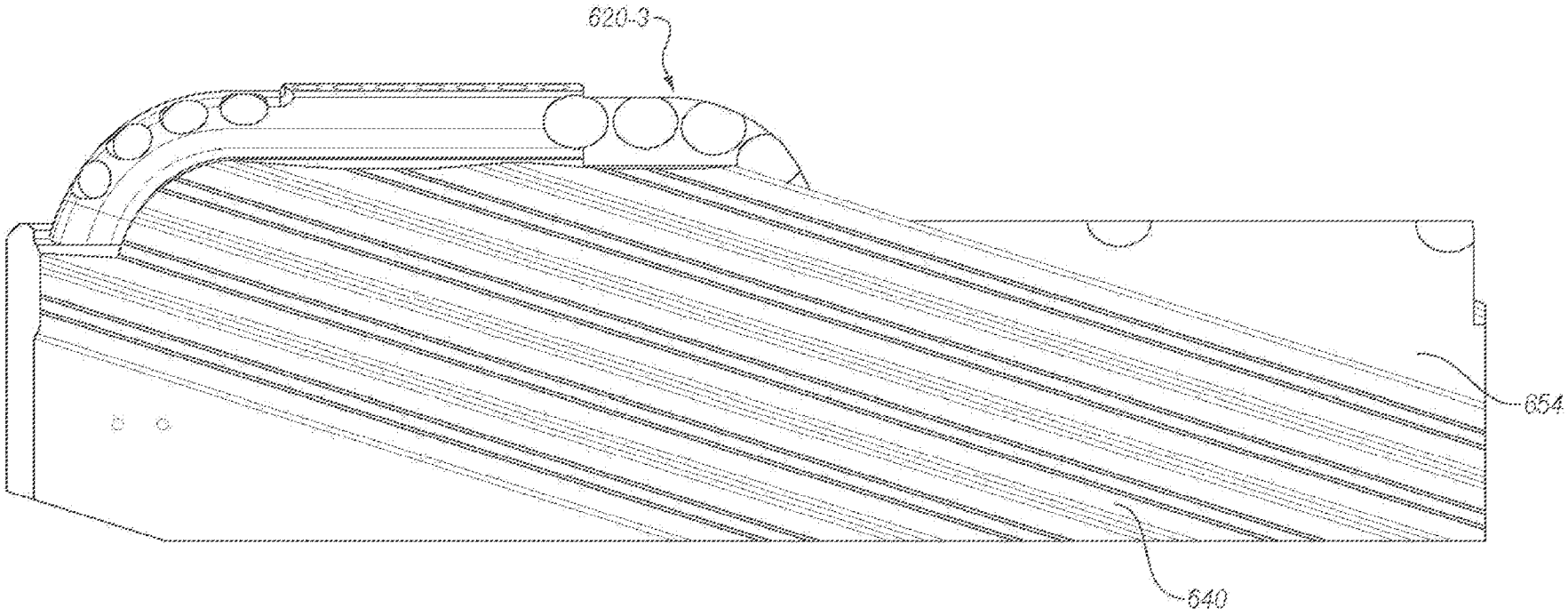

FIG. 6-1 through FIG. 6-3 are representations of an expandable block set 614 in the expanded position in various stages of wear, according to at least one embodiment of the present disclosure. The expandable block set 614 may be inserted into a housing such as the housing 216 of FIG. 2-1, and expanded and retracted as discussed with respect to FIG. 2-1 through FIG. 2-3.

The expandable block set 614 includes a first segment 620-1, a second segment 620-2 uphole of the first segment 620-1, and a third segment 620-3 uphole of the second segment 620-2 and the first segment 620-1. The first segment 620-1 and the second segment 620-2 may form a first slot 660-1 between them, and the second segment 620-2 and the third segment 620-3 may form a second slot 660-2 between them.

The slots 660 have a slot width 664, which is the distance between an uphole end 666 of the downhole segment 620 and a downhole end 668 of the uphole segment 620. FIG. 6 illustrates embodiments of the segments 620 with a positive offset between the cutting profiles of the segments. As discussed below, the cutting profiles of segments may be arranged with a negative offset such that the downhole-most and radially inner-most cutting elements of an upper segment are arranged longitudinally downhole of the uphole-most and radially outer-most cutting elements of a lower segment. In some embodiments, the slot width 664 may be in a range having an upper value, a lower value, or upper and lower values including any of 0.5 cm, 0.6 cm, 0.8 cm, 1.0 cm, 1.2 cm, 1.4 cm, 1.5 cm, 1.6 cm, 1.8 cm, 2.0 cm, 2.5 cm, 5 cm, 10 cm, 20 cm, 30 cm, 40 cm, 50 cm, or any value therebetween. For example, the slot width 664 may be greater than 0.5 cm. In another example, the slot width 664 may be less than 50 cm. In yet other examples, the slot width 664 may be any value in a range between 0.5 cm and 50 cm. In some embodiments, it may be critical that the slot width 664 is greater than 1.0 cm to provide a fluid path to improve cooling of the segment 620 and to provide a clean break of the downhole segment 620 for the uphole segment 620. In some embodiments, the slot width 664 may be 1%, 5%, 10%, 20%, 25%, or more of a width of the segments 620. In some embodiments, the slot width 664 may be sufficiently small or distinct to separate the uphole segment 620 and the downhole segment 620, while being sufficiently large to insert and/or attach any cutting elements into the segment 620.

The slots 660 have a slot depth 670, which is the distance from a base of the slot 660 to an outermost surface of the segment 620. In some embodiments, the slot depth 670 may be in a range having an upper value, a lower value, or upper and lower values including any of 0.5 cm, 1.0 cm, 1.5 cm, 2.0 cm, 2.5 cm, 3.0 cm, 3.5 cm, 4.0 cm, 4.5 cm, 5.0 cm, 7.5 cm, 10 cm, 15 cm, or any value therebetween. For example, the slot depth 670 may be greater than 0.5 cm. In another example, the slot depth 670 may be less than 15.0 cm. In yet other examples, the slot depth 670 may be any value in a range between 0.5 and 15.0 cm. In some embodiments, it may be critical that the slot depth 670 is greater than 1.5 cm to expose the cutting elements of the uphole segment 620 when the downhole segment wears or breaks away. In some embodiments, the slot depth may be greater than or equal to half of the wellbore opening diameter of the pilot hole. In some embodiments, the slot depth 670 may be equal to or greater than (e.g., may extend at least) a cutting depth of the segments 620. For example, the segments 620 may have a plurality of cutting elements that extend from the outermost surface of the segment 620 toward the base 654. The distance from the outermost surface of the segment 620 to the innermost edge 671 of the innermost cutting element may be the cutting depth. The slot depth 670 may extend into the expandable block set 614 with at least the cutting depth (e.g., at least to the innermost edge 671 of the innermost cutting element) so that the uphole segment 620 may engage the formation with its entire height.

In the embodiment shown, the uphole end 666 of the first segment 620-1 extends out over the first slot 660-1 with a curvilinear profile. This may help to provide support for one or more gauge cutting elements in a cutter pocket 645 on the first segment 620-1. However, it should be understood that the uphole end 666 may have any shape, including square, diagonal, semicircular, any other shape, and combinations thereof. In some embodiments, the uphole end 666 has a convex shape similar to, but not limited to, the downhole edge 658 and the uphole edge of the third segment 620-3.

In some embodiments, the slot 660 may weaken the connection of the segment 620 from the base 654 at or near the uphole end 666 of the segment 620. Thus, as the segment 620 experiences wear at the downhole edge 658, the segment 620 may wear such that the downhole edge 658 "migrates" or moves back toward the slot 660. This may further weaken the connection between the segment 620 and the base 654. Weakening the connection between the segment 620 and the base 654 may help the segment 620 to break away from the base 654. This may help to provide the uphole segment 620 with a clear path to the formation or other wellbore element, thereby improving the efficacy of the uphole segment 620 as it takes over engagement of the formation or other wellbore element.

In the embodiment shown, the segments 620-1, 620-2, and 620-3 are integrally formed with the base 654. Put another way, the segments 620 are formed at the same time and as part of the same process as the base 654, such as through casting, additive manufacturing, machining, any other manufacturing mechanism, and combinations thereof. In some embodiments, the segments 620 may be manufactured separately from the base 654 and subsequently attached or connected to the base 654. For example, the segments 620 may be brazed, welded, attached with a mechanical fastener, otherwise attached to the base 654, and combinations thereof. In some embodiments, two or more segments 620 may be integrally formed with or connected to the same base.

In the embodiment shown, the segments 620 all have the same, sharply curved, or blunt, segment configuration 672. In some embodiments, expandable downhole cutting tools experience a significant amount of wear on a single cutting element. After that cutting element is worn out or breaks off the cutting tool, another element picks up the primary cutting load. To improve stability and provide support for the cutting element, the segment 620 has the blunt segment configuration 672 shown. Furthermore, by providing multiple segments 620 having the same segment configuration 672, when an entire segment 620 breaks away from the base 654, the uphole segment 620 may continue to cut or engage the formation using the same segment configuration 672.

In the embodiment shown, each segment 620 has the same segment configuration 672 that includes the same types and arrangements of cutting elements. However, it should be understood that different segments 620 may have different segment configuration 672, having a different shape, different types of cutting elements, different arrangements of cutting elements, and combinations thereof. In this manner, an operator may design an expandable block set 614 to operate in many different drilling conditions, thereby improving the versatility and increasing the operating life of the expandable block set 614.

As discussed herein, the expandable block set 614 may engage the formation or other wellbore element, causing wear to the first segment 620-1, which may eventually wear or break away from the base 654, as may be seen in FIG. 6-2. In this manner, the second segment 620-2 may become the downhole-most segment 620 on the expandable block set 614. As may be seen, as the first segment 620-1 breaks away from the base 654, the base 654, including the splines 640 on the base 654, remains intact or mostly intact below where the first segment 620-1 used to be.

As the expandable block set 614 continues to engage the formation or other wellbore element, the second segment 620-2 may wear or break away from the base 654, as may be seen in FIG. 6-3. In this manner, the third segment 620-3 may become the downhole-most segment 620 on the expandable block set 614. As may be seen, as the second segment 620-2 breaks away from the base 654, the base 654, including the splines 640 on the base 654, remains intact or mostly intact radially below where the second segment 620-2 used to be.

Figure 7:
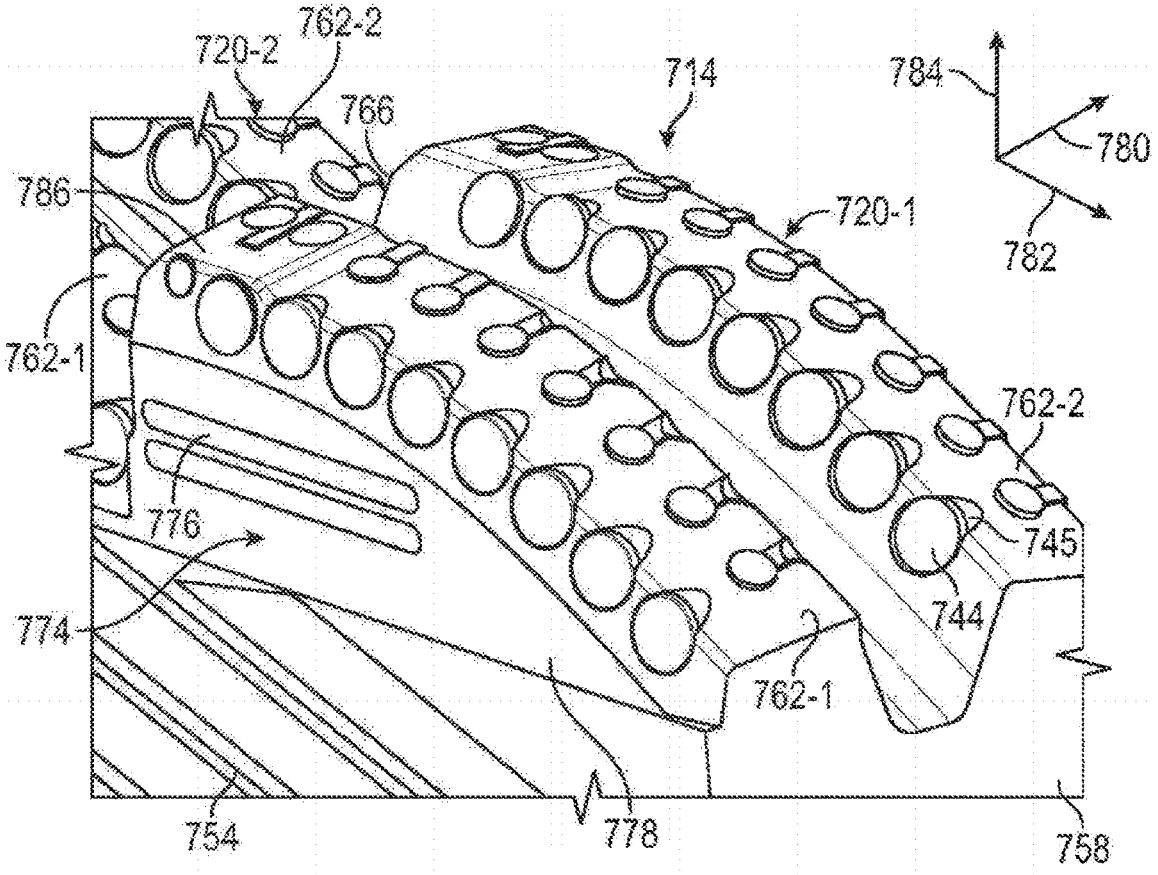
FIG. 7 is a representation of a perspective view of an expandable block set having a breakaway feature, according to at least one embodiment of the present disclosure.

FIG. 7 is a representation of an expandable block set 714 including a segment 720-1 and a segment 720-2 (collectively 720), having a breakaway feature 774, according to at least one embodiment of the present disclosure. While the segment 720-1 with the cutting elements 744 or inserts (e.g., in pockets 745) is largely intact without significant wear or degradation, it is desirable for the segment 720-1 to remain engaged with the formation or wellbore element. As the segment 720-1 wears such that cutting elements or inserts are worn or lost, the cutting efficiency of the segment 720-1 decreases. The breakaway features 774 described herein are configured to rapidly weaken the segment 720-1 of the block set 714 to facilitate removal of the segment 720-1 after a wear threshold has been met. In some embodiments, the wear threshold is based on a percentage of the cutting elements of the segment 720-1 that remain. For example, the wear threshold may be met when greater than 20%, 30%, 40%, 50% or more of the cutting elements of the segment 720-1 have worn or been lost. In some embodiments, the wear threshold is based on a percentage of the segment 720-1 that remains at a predefined longitudinal position. For example, the wear threshold may be met when greater than 20%, 30%, 40%, or 50% of the radial extension from the base 754 of the segment 720-1 proximate the breakaway feature 774 has worn away or been removed. In some embodiments, wear of the segment 720-1 such that the wear threshold is exposed to the formation or wellbore element may cause the rapid removal of the respective segment 720-1.

FIG. 7 illustrates breakaway grooves 776 on a leading face 778 of the segment 720-1. The breakaway grooves 776 may extend in a circumferential direction 780 into the segment 720-1 and in a longitudinal direction 782 along the leading face 778 of the segment 720-1. While two breakaway grooves 776 are illustrated, it is appreciated that more or fewer circumferential grooves 776 may be arranged on other embodiments of the segment 720-1. When the downhole edge 758 of the segment 720-1 approaches or contacts the breakaway grooves 776, the removed material of the breakaway grooves 776 weakens the remaining portion of the segment 720-1 and accelerates its degradation and removal from the block set 714. In some embodiments, the one or more breakaway grooves 776 are on leading faces 778 of the leading row 762-1 and the trailing row 762-2 of the segment 720-1. Moreover, the one or more breakaway grooves 776 may be on trailing faces of the segment 720-1. The one or more breakaway grooves 776 may extend in the circumferential direction 780 approximately 1%, 5%, 10%, 20%, 25%, or more of a width of the segment 720-1. The one or more breakaway grooves 776 may be arranged nearer to the uphole end 766 of the segment 720-1 than to the downhole end 758 of the segment 720-1. The breakaway features 774 may be arranged on each of the segments 720 of the block set 714, or on one or more of the downhole-most segments.

In some embodiments, the breakaway features 774 may extend in a radial direction 784, such as through a gauge surface 786 of the segment 720-1. The breakaway features 774 may be formed with the segment 720-1, or machined into the segment prior to installation of the block set 714. In some embodiments, such as an additively manufactured block set 714, the breakaway features 774 may be one or more voids formed within a body of the segment 720-1. Regardless of the formation and orientation of the breakaway features 774, the reduced material of the segment 720-1 due to the breakaway feature is configured to weaken the segment to accelerate the degradation and removal of the segment 720-1 from the block set 714 after a wear threshold of the segment 720-1 has been met.

Figure 8:
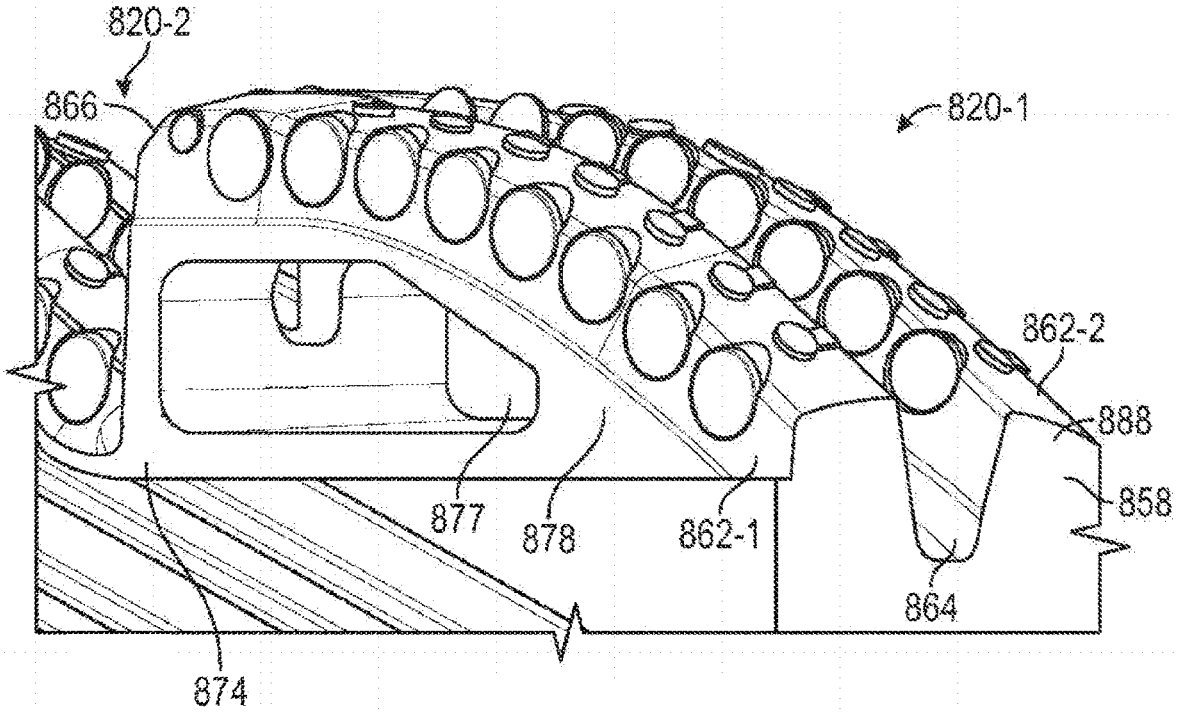
FIG. 8 is a representation of a perspective view of an expandable block set having a breakaway feature, according to at least one embodiment of the present disclosure.

FIG. 8 is a representation of an expandable block set 814 including a segment 820-1 and a segment 820-2 (collectively 820), and having a breakaway feature 874 that extends circumferentially through the segment 820-1, according to at least one embodiment of the present disclosure. The breakaway feature 874 may include a void 877 extending in a circumferential direction through a leading face 878 to a trailing face 888 of the segment 820-1. In some embodiments, the void 877 is at least partially filled with another material, such as a softer and/or less wear resistant material than the remainder of the segment 820-1. For example, the void 877 may be at least partially filled with a metallic material such as steel, aluminum, or brass. The void 877 may be at least partially filled with a ceramic, plastic, or elastomeric material. The one or more materials within the void are configured to support the profile of the segment 820-1 while the cutting profile of the segment 820-1 remains intact and is worn less than a wear threshold. The void 877 may be arranged nearer to the uphole end 866 of the segment 820-1 than to the downhole end 858 of the segment 820-1. A minimum thickness of the segment 820-1 around the void 877 may be approximately 10%, 20%, 30% or 40% of a width of the segment 820-1. In some embodiments, the void 877 may extend through one or more rows 862-1, 862-2 and channels 864 of the segment 820-1.

Figure 9:
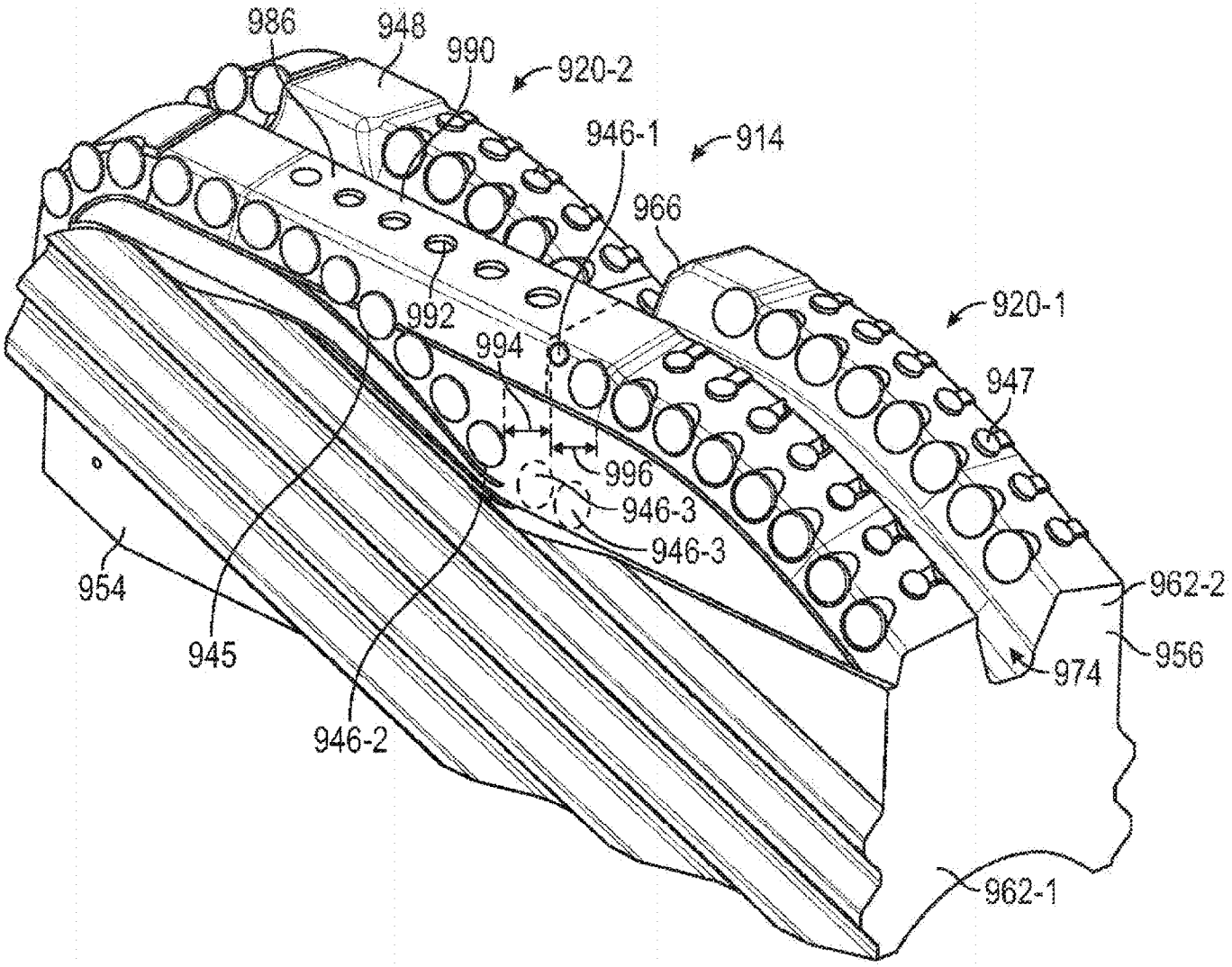
FIG. 9 is a representation of a perspective view of an expandable block set having multiple segments and a continuous body, according to at least one embodiment of the present disclosure.

FIG. 9 is a representation of an expandable block set 914 with a continuous body 990 having a plurality of segments (collectively 920), according to at least one embodiment of the present disclosure. The continuous body 990 of the expandable block set 914 extends radially from a single base 954. A first segment 920-1 is located at a downhole end 956 of the expandable block set 914, and a second segment 920-2 is located uphole of the first segment 920-1. In some embodiments, the expandable block set 914 may have three or more segments. Whereas the slots described above separate the segments, the continuous body 990 joins two or more adjacent segments 920. The cutter pockets 945 and the cutting elements 946 of a portion of the second segment 920-2 are embedded within the continuous body 990. That is, one or more of the cutting elements 946 are embedded such that the continuous body 990 radially covers the cutting elements 946 while the continuous body 990 and the first segment 920-1 remain attached portions of the expandable block set 914. The one or more cutting elements 946 embedded in the continuous body 990 are radially offset from the gauge portion 948 and the outer surface 986. The continuous body 990 may be integrally formed with the expandable block set 914 or separately attached (e.g., welded, bolted, brazed) thereto. In some embodiments, a slot or groove may be formed or machined into the continuous body 990 around the cutter pockets 945 embedded within the continuous body, thereby facilitating attachment of the cutting elements 946.

During downhole drilling operations, the expandable block set 914 may be expanded to engage the formation, a wellbore element, or both. The first segment 920-1 may be downhole-most segment 920. As the first segment 920-1 engages the formation or wellbore element, the first segment 920-1 may experience wear. Degradation of the first segment 920-1 leads to exposure of the second segment 920-2 uphole of the first segment 920-1. The continuous body 990 may facilitate a more gradual transition of the second segment 920-2 with the formation or wellbore element after removal of the first segment 920-1 than a slot between the segments 920 of the expandable block set 914. Additionally, or in the alternative, the continuous body 990 may reduce impacts and reduce premature wear on the embedded profile of the second segment 920-2 while cutting elements of the first segment 920-1 remain. That is, the continuous body 990 may reduce the instantaneous loading of the second segment 920-2 that may otherwise prematurely degrade the second segment 920-2 after removal of the first segment 920-1.

A gauge section 948 of the expandable block set 914 is located uphole of the segments 920. The continuous body 990 may longitudinally extend the gauge section 948 of the expandable block 914 while the first segment 920-1 remains attached to the expandable block set 914. In some embodiments, cutting elements, wear elements 947, or hardfacing, or any combination thereof may be arranged on a radially outer surface 986 of the continuous body 990. The radially outer surface 986 of the continuous body 990 may be at the gauge diameter of the gauge section 948 or a lesser diameter. Openings 992 of the continuous body 990 may facilitate coupling the separately formed continuous body 990 to the base 954. Additionally, or in the alternative, cutting elements 946 or wear elements 947 may be inserted within the openings 992. The wear elements 947 on the radially outer surface 986 of the continuous body 990 may be more impact resistant and tougher than the cutting elements 946. In some embodiments, openings 992 are breakaway features that accelerate removal of the continuous body 990 that is radially outside the cutting elements of the second segment 920-2 after removal of the first segment 920-1.

The segments 920 of the expandable block set 914 may have multiple rows 962-1, 962-2 circumferentially separated by a longitudinal channel 974. While FIG. 9 illustrates the continuous body 990 on the leading row 962-1 but not the trailing row 962-2, it is appreciated that some embodiments of the expandable block set 914 may have a continuous body 990 on one or more trailing circumferential rows. The longitudinal channel 974 may extend through the continuous body 990 between the leading row 962-1 of the second segment 920-2 and the trailing row 962-2 of the second segment 920-2.

The downhole end 968 of the second segment 920-2 may be arranged with a positive offset 994 from the uphole end 966 of the first segment 920-1. That is, the most downhole portion of the cutting element 946-2 at the downhole end 968 of the second segment 920-2 is arranged the positive offset 994 in a longitudinal direction from the most uphole portion of the cutting element 946-1 at the uphole end 966 of the first segment 920-1. In some embodiments, the downhole end 968 of the second segment 920-2 may be arranged with a negative offset 996 from the uphole end 966 of the first segment 920-1. For example, one or more cutting elements of the first segment 920-1 may radially overlap one or more cutting elements of the second segment 920-2. FIG. 9 illustrates with phantom lines 946-3 cutting elements of the second segment 920-2 that are arranged with the negative offset 996 from the most uphole portion of the cutting element 946-1 at the uphole end 966 of the first segment 920. Segments 920 arranged on a continuous body 990 with a negative offset 996 may facilitate the arrangement or more cutting elements 946 and/or more segments 920 along the expandable block set 914 compared to an expandable block set of the same length having a positive offset between segments.

Figure 10:
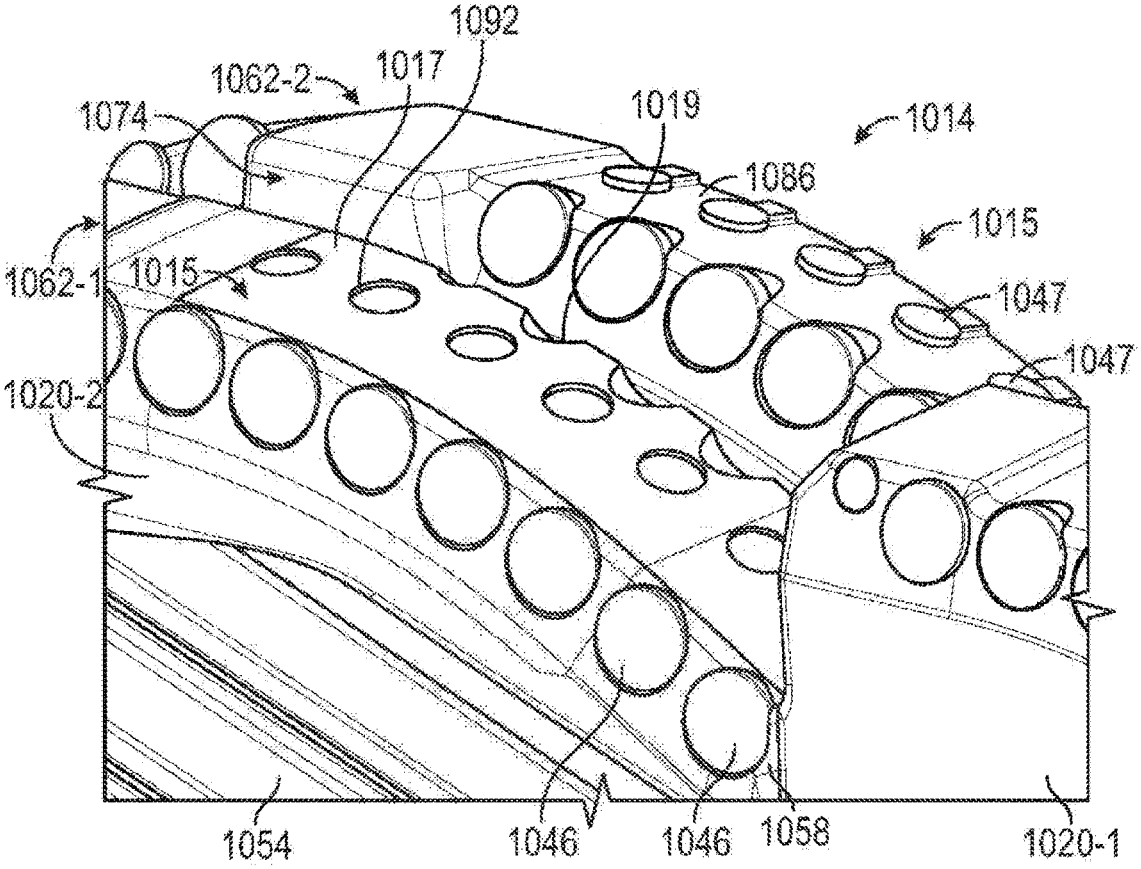
FIG. 10 is a representation of a perspective view of an expandable block set with a segment protection feature, according to at least one embodiment of the present disclosure.
Figure 11:
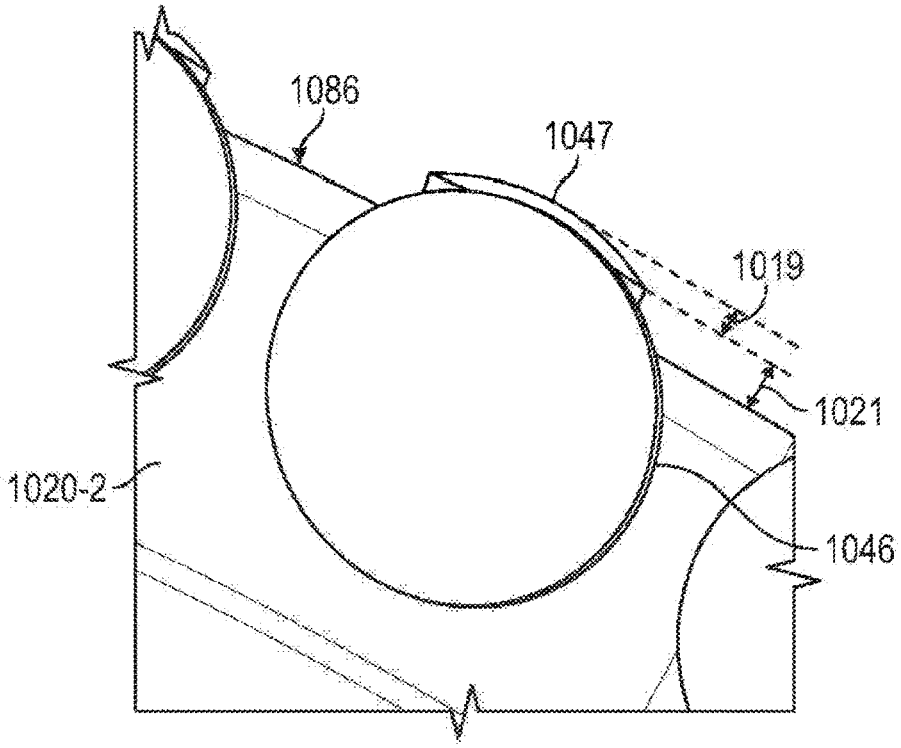
FIG. 11 is a representation of a profile view of portion of the segment of FIG. 10 having a cutting element and wear element.
Figure 12:
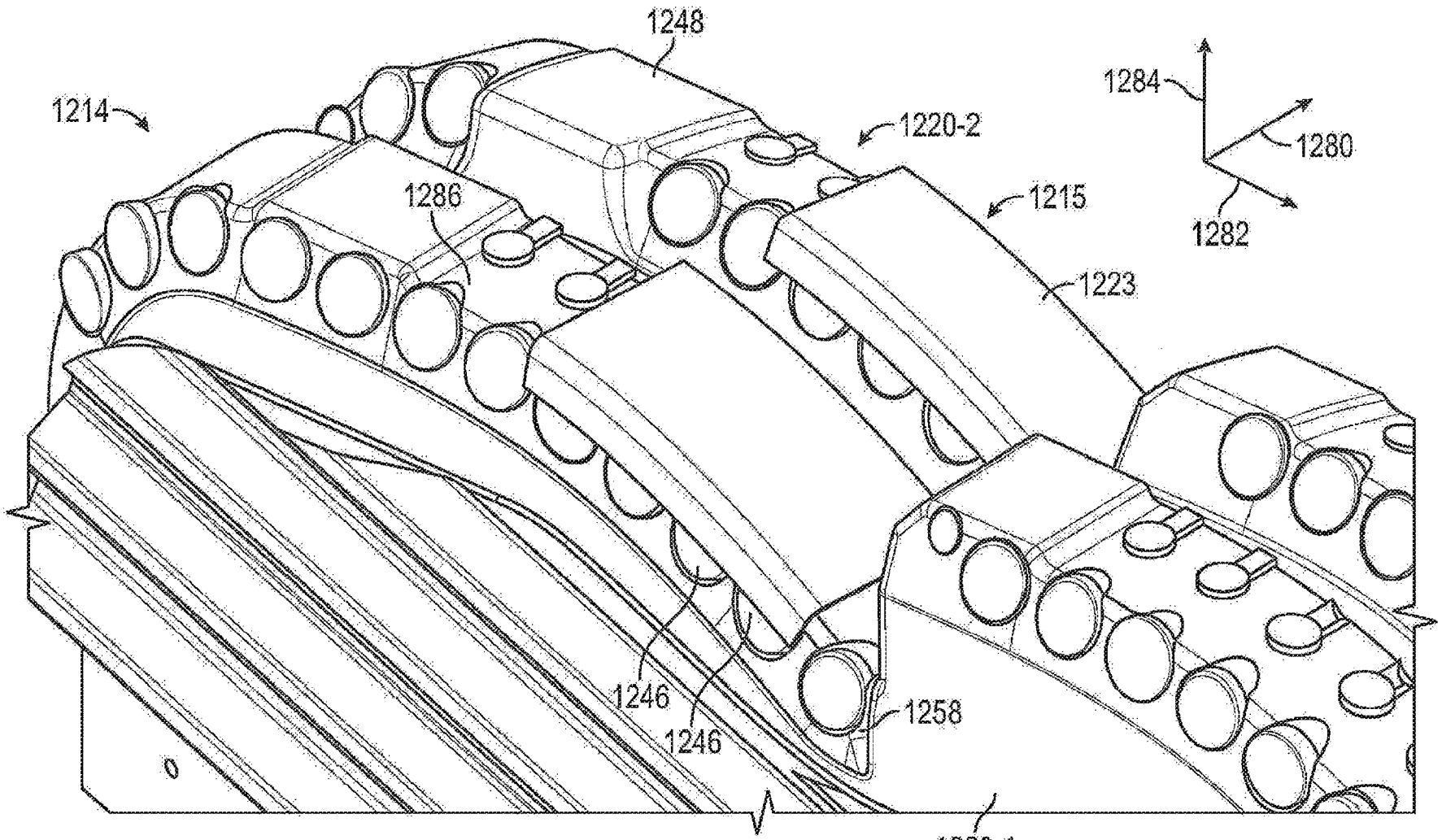
FIG. 12 is a representation of a perspective view of an expandable block set with a segment protection feature, according to at least one embodiment of the present disclosure.

It is desirable for the cutting elements of the uphole segments of an expandable block set to be protected from premature wear and impacts while the most downhole segment engages with the formation or wellbore elements. FIGS. 10-12 illustrate embodiments of segment protection features 1015 that may reduce engagement of the cutting elements 1046 of the uphole segments 1020-2 with the formation or wellbore elements while the downhole segment 1020-1 remains attached to the base 1054 of the expandable block set 1014. The segment protection features 1015 extend from an outer surface 1086 of the upper segments 1020-2, extending radially beyond proximate cutting elements 1046 of the respective upper segments 1020-2.

FIG. 10 illustrates different segment protection features 1015 on the leading row 1062-1 and the trailing row 1062-2. A wear top 1017 on the leading row 1062-1 may be configured to take the initial load from the formation or wellbore element after the downhole segment 1020-1 is removed, then rapidly wear away to expose the cutting elements 1046 of the uphole segment 1020-2. The wear top 1017 may be a tough material with more impact resistance than the cutting elements 1046. For example, the wear top 1017 may be a steel or other alloy. The wear top 1017 may be an extension of the base 1054 or a separate component attached to the outer surface 1086. In some embodiments, the wear top 1017 is a welded or sprayed material, such as a hardfacing material. Recesses 1019 of the wear top 1017 with the longitudinal channel 1074 may facilitate attachment of cutting elements 1046 near the downhole end 1058 of the trailing row 1062-2. Openings 1092 of the wear top 1017 may facilitate coupling the wear top 1017 to the segment 1020-2, may be configured to receive wear elements 1047, or any combination thereof.

The wear elements 1047 on the trailing row 1062-2 may be configured as segment protection features 1015 to take the initial load from the formation or wellbore element after the downhole segment 1020-1 is removed. In some embodiments, one or more wear elements 1047 extend a protection distance radially beyond the cutting element 1046 that circumferentially leads the respective wear element 1047, as shown in FIG. 11. In some embodiments, the one or more wear elements 1047 may extend an exposure distance 1021 radially from the outer surface 1086 that is approximately the same as the leading cutting element 1046. The wear element 1047 arranged at the exposure distance 1021 may be a depth-of-cut control feature for the respective leading cutting element 1046.

FIG. 12 illustrates an embodiment of a segment protection feature 1215 with an element cap 1223. The element cap 1223 may be arranged to cover one or more cutting elements 1246 of the uphole segments 1220-2. The element cap 1223 may be configured to cover the leading surfaces of one or more cutting elements 1246 and radially outer surfaces of the one or more cutting elements 1246. That is, the element cap 1223 may at least partially surround the cutting elements 1246 in the circumferential direction 1280 and the radial direction 1284. The element cap 1223 covers at least a portion of the radially outer surface 1286 of the uphole segment 1220-2. In some embodiments, the element cap 1223 extends along the uphole segment 1220-2 in the longitudinal direction 1282 to cover multiple cutting elements 1246. In some embodiments, the element cap 1223 covers only a portion of the circumferentially leading edge and a portion of the radially outer surface 1286 of the uphole segment 1220-2. In some embodiments, the element cap 1223 covers a portion of the circumferentially leading edge, a portion of the radially outer surface 1286, and at least a portion of the circumferentially trailing edge of the uphole segment 1220-2. The cutting elements 1246 of the uphole segment 1220-2 nearer the gauge region 1248 may be more likely exposed to impacts or wear even while the downhole segment 1220-1 remains attached and engaged with the formation. Accordingly, some embodiments of the element cap 1223 may cover the cutting elements 1246 of the uphole segment 1220-2 that are nearer the gauge region 1248 without covering the cutting elements 1246 near the downhole end 1258 of the uphole segment 1220-2.

One or more element caps 1223 may be arranged along an uphole segment 1220-2 of the expandable block set 1214. For example, one or more elements caps 1223 may be arranged to cover each of the cutting elements 1246 of the uphole segment 1220-2. The element cap 1223 is configured to take the initial load from the formation or wellbore element on the uphole segment 1220-2 after the downhole segment 1220-1 is removed, then the element cap 1223 is configured to rapidly wear away or otherwise be removed to expose the cutting elements 1246 of the uphole segment 1220-2. In some embodiments, the element cap 1223 is configured to reduce incidental exposure of the cutting elements 1246 to fluids or elements in the downhole environment that may prematurely degrade (e.g., chip, fracture, corrode) the cutting elements 1246 of the uphole segment 1220-2.

The element cap 1223 may be a tough material with more impact resistance than the cutting elements 1246. For example, the element cap 1223 may be a steel or other alloy. In some embodiments, the element cap 1223 is a composite, elastomeric, or polymeric material. The element cap 1223 may be mechanically attached to the uphole segment 1220-2, such as via one or more fasteners, snaps, clips, or mating features of the uphole segment and element cap 1223. In some embodiments, the element cap 1223 is bonded to the uphole segment 1220-2, such as via an adhesive, weld, or braze material.

The segment protection features described above with FIGS. 10-12 may be utilized with the uphole segments of any of the expandable block sets described above. Moreover, the segment protection features may be combined and mixed in any combination. The segment protection features of FIGS. 10-12 may be combined in some embodiments with the breakaway features described with FIGS. 7 and 8.

Figure 13:
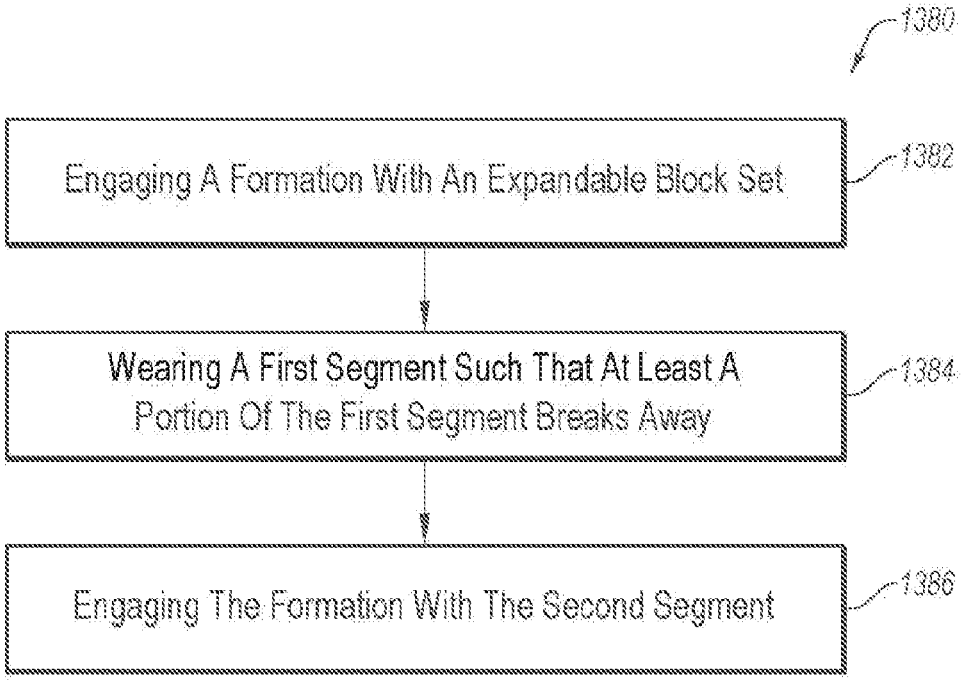
FIG. 13 is a representation of a method for operating a downhole tool, according to at least one embodiment of the present disclosure.

FIG. 13 is a representation of a method 1380 for operating an expandable downhole tool, according to at least one embodiment of the present disclosure. The method 1380 may include engaging a formation with an expandable block set at 1382. The expandable block set may include a first segment and a second segment arranged longitudinally. The first segment may extend at least as far from a housing of the expandable downhole tool as the second segment.

The method 1380 may include wearing a first segment such that at least a portion of the first segment breaks away from the expandable block set at 1384. As the first segment wears away, the second segment may extend further from the housing of the expandable downhole tool than the first segment. After the first segment wears or breaks free from the expandable block set, the expandable block set engages the formation with the second segment more than the first segment at 1386. For example, the second segment may take more of the engagement load, or more of the longitudinal engagement load, than the first segment.

In some embodiments, the first segment has a first segment configuration, or combination of shape, cutting element type, and cutting element arrangement. The second segment has a second segment configuration. The first segment configuration may be the same as the second segment configuration. In this manner, the second segment may be a backup segment for the first segment. In some embodiments, the first segment configuration may be different from the second segment configuration. The first segment configuration may be optimized to erode a first formation type and the second segment configuration may be optimized to erode a second formation type. The first segment may erode the first formation type and enter the second formation type. The first segment may not be optimized to erode the second formation type, and may wear away or break free from the base of the first segment. This may expose the second segment to the second formation type. Because the second segment is optimized for the second formation type, an expandable tool that includes the first segment as a lower segment and the second segment as the upper segment may be optimized for both the first formation type and the second formation type. This may result in an increased service life, thereby reducing operating costs and reducing delays caused by tripping out to change blades of the expandable downhole tool.

The embodiments of the expandable downhole tools have been primarily described with reference to wellbore drilling operations; the expandable downhole tools described herein may be used in applications other than the drilling of a wellbore. In other embodiments, expandable downhole tools according to the present disclosure may be used outside a wellbore or other downhole environment used for the exploration or production of natural resources. For instance, expandable downhole tools of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An expandable tool, comprising:

an expandable block set, including:

a first segment having a first segment configuration; and a second segment having a second segment configuration, the first segment and the second segment being arranged longitudinally, wherein the first segment is configured to break away to expose the second segment.

2. The tool of claim 1, wherein an upper end of the first segment is in contact with a lower end of the second segment.

3. The tool of claim 1, wherein the expandable block set comprises a single base, and the first segment and the second segment are integrally formed with the single base.

4. The tool of claim 1, wherein the first segment configuration is different from the second segment configuration.

5. The tool of claim 1, wherein the first segment configuration is the same as the second segment configuration.

6. The tool of claim 1, wherein the first segment is separated from the second segment with a spacer.

7. The tool of claim 1, wherein the expandable block set comprises a continuous body between the first segment and the second segment, the second segment comprises a second plurality of cutting elements, and one or more of the cutting elements of the second plurality of cutting elements are embedded within the continuous body.

8. The tool of claim 1, wherein the first segment comprises a first plurality of cutting elements, and the second segment comprises a second plurality of cutting elements; wherein one or more cutting elements of the first plurality radially overlap with one or more cutting elements of the second plurality of cutting elements with a negative offset from an uphole end of the first segment.

9. The tool of claim 1, wherein the first segment and the second segment are separately formed.

10. The tool of claim 1, wherein the first segment comprises one or more breakaway features configured to weaken the first segment after a wear threshold of the first segment has been met.

11. The tool of claim 1, wherein the second segment comprises a second plurality of cutting elements and a segment protection feature, wherein the segment protection feature extends from an outer surface of the second segment radially beyond the second plurality of cutting elements.

12. A method for operating a downhole tool, comprising:

engaging a formation with an expandable block set, the expandable block set including a first segment longitudinally arranged with a second segment, wherein the first segment extends radially from a housing of the downhole tool at least as far as the second segment;

wearing the first segment such that at least a portion of the first segment breaks free from the expandable block set and the second segment extends further from the housing than the first segment; and after the portion of the first segment breaks free from the expandable block set, engaging the formation with the second segment more than the first segment.

13. The method of claim 12, wherein the first segment is independent from the second segment.

14. The method of claim 12, wherein the first segment comprises a breakaway feature, wearing the first segment comprises removing a wear threshold of material from the first segment proximate the breakaway feature, and an entirety of the first segment breaks free from the expandable block set after the wear threshold of material is removed.

15. The method of claim 12, wherein the first segment comprises a first plurality of cutting elements, and the second segment comprises a second plurality of cutting elements; wherein one or more cutting elements of the first plurality radially overlap with one or more cutting elements of the second plurality of cutting elements with a negative offset from an uphole end of the first segment.

16. An expandable tool, comprising:

an expandable block set configured to expand and engage a wellbore wall during a downhole operation in an operation direction, including:

a first segment having a first segment configuration; and a second segment having a second segment configuration, the first segment and the second segment being arranged longitudinally, wherein the first segment is configured to break away during the downhole operation in the operational direction to expose the second segment to continue the downhole operation in a downhole direction.

17. The expandable tool of claim 16, wherein the downhole operation is a wellbore forming operation.

18. The expandable tool of claim 17, wherein:

the first segment is positioned to engage the wellbore wall during the downhole operation;

a first portion of the second segment is positioned to not engage the wellbore wall when the first segment engages the wellbore wall; and the first segment is configured to break away during the downhole operation to expose the first portion of the second segment such that the first portion of the second segment engages the wellbore wall to contribute to the downhole operation.

19. The expandable tool of claim 16, wherein the first segment includes one or more breakaway grooves formed in one or more of a leading face or a trailing face of the first segment and configured to accelerate degradation of the first segment to break the first segment away from the expandable block set when a wear threshold of the first segment has been met.

20. The expandable tool of claim 16, wherein the first segment includes one or more breakaway voids formed from a leading face to a trailing face of the first segment and configured to accelerate degradation of the first segment to break the first segment away from the expandable block set when a wear threshold of the first segment has been met.

* * * * *